US011680455B2

(12) United States Patent
Doster et al.

(10) Patent No.: US 11,680,455 B2
(45) Date of Patent: Jun. 20, 2023

(54) THREE AXIS VIBRATING DEVICE

(71) Applicant: Rubicon Oilfield International, Inc., Houston, TX (US)

(72) Inventors: Michael Doster, Houston, TX (US); Mason Panahi, Houston, TX (US)

(73) Assignee: RUBICON OILFIELD INTERNATIONAL, INC., Houston, TX (US)

( * ) Notice: Subject to any disclaimer, the term of this patent is extended or adjusted under 35 U.S.C. 154(b) by 0 days.

(21) Appl. No.: 16/682,700

(22) Filed: Nov. 13, 2019

(65) Prior Publication Data

US 2020/0149367 A1 May 14, 2020

Related U.S. Application Data

(60) Provisional application No. 62/760,127, filed on Nov. 13, 2018.

(51) Int. Cl.
*E21B 31/00* (2006.01)
*E21B 34/10* (2006.01)
(Continued)

(52) U.S. Cl.
CPC ..... *E21B 31/005* (2013.01); *E21B 7/24* (2013.01); *E21B 28/00* (2013.01); *E21B 34/10* (2013.01)

(58) Field of Classification Search
CPC ..... E21B 7/24; E21B 34/06; E21B 31/005; E21B 34/10; E21B 28/00
See application file for complete search history.

(56) References Cited

U.S. PATENT DOCUMENTS 8,544,567 B2 * 10/2013 Comeau ..... E21B 10/602 239/487
9,091,123 B2 * 7/2015 Gust ..... E21B 7/24
(Continued)

FOREIGN PATENT DOCUMENTS

AU 619086 B2 1/1992
AU 638767 B2 7/1993
(Continued)

OTHER PUBLICATIONS

Written Opinion of the International Searching Authority as issued in International Patent Application No. PCT/US2019/061190, dated Mar. 6, 2020.
(Continued)

*Primary Examiner* — Nicole Coy
(74) *Attorney, Agent, or Firm* — MH2 Technology Law Group LLP

(57) ABSTRACT

Provided is a downhole vibrating tool comprising an interconnected power section, axial shock assembly and lateral vibration assembly wherein the power section comprising a rotor and a stator, the rotor comprising a plurality of lobes and the stator comprising a second plurality of recesses adapted to receive the plurality of lobes, the number of recesses greater than the number of lobes; the axial shock assembly comprising a valve assembly, the axial shock assembly adapted to vary fluid flow therethrough; and the lateral vibration assembly comprising an eccentric mass; wherein the power section, the axial shock assembly and the lateral vibration assembly are aligned linearly.

21 Claims, 25 Drawing Sheets

(51) Int. Cl.
*E21B 28/00* (2006.01)
*E21B 7/24* (2006.01)

(56) References Cited

U.S. PATENT DOCUMENTS

| | | | | |
|---|---|---|---|---|
| 9,605,484 | B2 * | 3/2017 | Gillis | E21B 44/00 |
| 9,702,246 | B2 * | 7/2017 | White | E21B 47/20 |
| 9,840,883 | B2 | 12/2017 | Schulta et al. | |
| 10,829,995 | B2 | 11/2020 | Tonti et al. | |
| 2001/0054515 | A1 * | 12/2001 | Eddison | E21B 7/18 175/56 |
| 2002/0092682 | A1 | 7/2002 | Blair et al. | |
| 2003/0024739 | A1 | 2/2003 | Runquist et al. | |
| 2003/0056985 | A1 | 3/2003 | Hahn et al. | |
| 2003/0111269 | A1 | 6/2003 | Blair et al. | |
| 2004/0108138 | A1 | 6/2004 | Cooper et al. | |
| 2005/0045344 | A1 | 3/2005 | Fraser et al. | |
| 2005/0121231 | A1 | 6/2005 | Clayton | |
| 2005/0211471 | A1 | 9/2005 | Zupanick | |
| 2006/0164917 | A1 | 7/2006 | Ganesan et al. | |
| 2007/0114063 | A1 | 5/2007 | Wilfredo | |
| 2008/0000634 | A1 | 1/2008 | Gaudette et al. | |
| 2008/0142264 | A1 | 6/2008 | Hall et al. | |
| 2008/0296015 | A1 | 12/2008 | Hall et al. | |
| 2009/0016159 | A1 | 1/2009 | Fraser et al. | |
| 2009/0095470 | A1 | 4/2009 | Gaudette et al. | |
| 2009/0178799 | A1 | 7/2009 | Shewchuk | |
| 2009/0223676 | A1 | 9/2009 | Eddison et al. | |
| 2009/0266612 | A1 | 10/2009 | Allahar et al. | |
| 2009/0301744 | A1 | 12/2009 | Swinford | |
| 2010/0116551 | A1 | 5/2010 | Southard | |
| 2010/0126734 | A1 | 5/2010 | Erikson | |
| 2010/0126774 | A1 | 5/2010 | Downton | |
| 2010/0224412 | A1 | 9/2010 | Allahar | |
| 2011/0031020 | A1 | 2/2011 | Cote | |
| 2011/0061938 | A1 | 3/2011 | Miszewski | |
| 2011/0308797 | A1 | 12/2011 | Umphries et al. | |
| 2012/0067595 | A1 | 3/2012 | Noske et al. | |
| 2013/0168092 | A1 | 7/2013 | Evans | |
| 2013/0186686 | A1 | 7/2013 | Heisig | |
| 2013/0240268 | A1 | 9/2013 | Crowley et al. | |
| 2013/0270013 | A1 | 10/2013 | Horsch | |
| 2013/0306376 | A1 | 11/2013 | Walerianczyk et al. | |
| 2013/0319767 | A1 | 12/2013 | Wilson et al. | |
| 2014/0041943 | A1 | 2/2014 | Lanning et al. | |
| 2014/0151068 | A1 | 6/2014 | Gilleylen et al. | |
| 2014/0190749 | A1 | 7/2014 | Lorenson et al. | |
| 2014/0196905 | A1 | 7/2014 | Schultz et al. | |
| 2014/0246234 | A1 | 9/2014 | Gillis et al. | |
| 2014/0246240 | A1 * | 9/2014 | Lorenson | E21B 21/10 175/57 |
| 2014/0338978 | A1 | 11/2014 | Cote | |
| 2015/0075867 | A1 | 3/2015 | Eddison et al. | |
| 2015/0159437 | A1 | 6/2015 | Crowley et al. | |
| 2015/0345221 | A1 | 12/2015 | Gaikwad et al. | |
| 2016/0040493 | A1 | 2/2016 | Schultz et al. | |
| 2016/0090818 | A1 | 3/2016 | Noske et al. | |
| 2016/0201426 | A1 | 7/2016 | Cohen | |
| 2016/0281449 | A1 | 9/2016 | Lorenson et al. | |
| 2016/0341016 | A1 * | 11/2016 | Yin | E21B 43/088 |
| 2017/0138130 | A1 | 5/2017 | Heisig | |
| 2018/0038182 | A1 | 2/2018 | Schultz et al. | |
| 2019/0024459 | A1 * | 1/2019 | Sicilian | E21B 6/04 |
| 2019/0153822 | A1 | 5/2019 | Noske et al. | |
| 2019/0277092 | A1 | 9/2019 | Lebaron et al. | |
| 2019/0292867 | A1 | 9/2019 | Schultz et al. | |
| 2020/0123856 | A1 * | 4/2020 | Sicilian | E21B 7/24 |

FOREIGN PATENT DOCUMENTS

| | | | |
|---|---|---|---|
| AU | 654738 | B2 | 11/1994 |
| AU | 694860 | B2 | 7/1998 |
| AU | 700933 | B2 | 1/1999 |
| AU | 713625 | B2 | 12/1999 |
| AU | 2002359326 | B2 | 2/2007 |
| AU | 2005319151 | B2 | 5/2010 |
| AU | 2004286089 | B2 | 2/2011 |
| AU | 2007302573 | B2 | 4/2011 |
| AU | 2006301118 | B2 | 5/2011 |
| AU | 2010313668 | B2 | 8/2014 |
| AU | 2013205837 | B9 | 10/2014 |
| AU | 2012320368 | B2 | 2/2016 |
| AU | 2011320079 | B2 | 1/2017 |
| BE | 1004617 | A3 | 12/1992 |
| CA | 569204 | A | 1/1959 |
| CA | 586125 | A | 11/1959 |
| CA | 1165854 | A | 4/1984 |
| CA | 2178813 | C | 12/2005 |
| CA | 2546398 | A1 | 11/2006 |
| CA | 2255065 | C | 1/2007 |
| CA | 2312341 | C | 8/2007 |
| CA | 2621855 | A1 | 9/2007 |
| CA | 2651154 | A1 | 11/2007 |
| CA | 2663703 | A1 | 4/2008 |
| CA | 2680895 | A1 | 3/2011 |
| CA | 2487380 | C | 2/2013 |
| CN | 101283199 | B | 10/2008 |
| CN | 101105115 | B | 5/2010 |
| EP | 1923535 | A1 | 5/2008 |
| WO | 1991/010067 | A1 | 7/1991 |
| WO | 2002/055837 | A1 | 7/2002 |
| WO | 2005/049960 | A1 | 6/2005 |
| WO | 2005/079224 | A2 | 9/2005 |
| WO | 2008/005718 | A2 | 1/2008 |
| WO | 2009/134886 | A2 | 11/2009 |
| WO | 2010/151743 | A2 | 12/2010 |
| WO | 2013/186554 | A2 | 12/2013 |
| WO | 2014/172578 | A1 | 10/2014 |
| WO | 2015/004203 | A1 | 1/2015 |

OTHER PUBLICATIONS

Hwang (Authorized Officer), International Search Report dated Mar. 6, 2020, PCT Application No. PCT/US2019/061190, 4 pages.

* cited by examiner

THREE AXIS VIBRATING DEVICE

CROSS REFERENCE TO RELATED APPLICATIONS

This application claims priority to U.S. Provisional Patent Application 62/760,127, filed Nov. 13, 2018.

BACKGROUND OF THE INVENTION

Field of the Invention

The present disclosure relates generally to downhole drilling, and more specifically to downhole vibratory tools for reducing friction along the drill string and/or work string, referred to herein as the "drill string."

Description of the Related Art

In subsurface drilling ("downhole drilling") such as for hydrocarbon extraction, holes ("wellbores") are drilled from which the hydrocarbons are produced, and frequently tools are pushed tens of thousands of feet underground. These downhole vibrating tools ("vibrating tools") operate at the end of the drill string. The wellbores can vary in path, from vertical to horizontal and beyond.

A frequent problem for drilling engineers is tool durability and reliability that can handle the extreme forces that occur downhole, including frictional forces between the surrounding formation and the drill string resisting the forward motion of the drill string. Moreover, in directional drilling, high frictional forces resisting forward motion can result in forces building up in the drill string closer to the surface which raises the risk of buckling the drill string, which results in stick-slip, causing material fatigue or failure of the bottom hole assembly. These high frictional forces along the drill string also reduce the net weight on the drill bit decreasing rate of penetration. Damage and forces resisting forward motion increase the time necessary to reach a downhole target depth due to, e.g., simple restriction in motion from drag and from reduced ability to transfer weight to the drill bit. This in turn increases drilling time and increases drilling costs. Lowered weight on the drill bit is a problem particularly acute in more modern drilling operations, where wellbores frequently are drilled laterally or, in certain scenarios, at angles upward toward the surface. The more extended reach a wellbore is, the more likely these frictional forces will be significant enough to hinder the drilling processes. In these cases, the weight on the drill bit is substantially lessened than in a vertical scenario because the drill string is at an angle to the direction of gravity, including being perpendicular to gravity and at times opposing gravity. Moreover, in any drilling operation, reducing time to reach a target zone is viewed as vital because of the high cost of drilling. At a simplified level, an oil company's margins are inversely related to drilling time because development costs are significantly time-based, e.g., equipment rental rates and personnel salaries. As nonproductive time, including the time to reach the target depth, increases production costs increase and margins shrink. As such, oil companies constantly seek new methods to reduce drilling time.

The drilling process of a single wellbore is a complicated task spread out over tens of thousands of feet involving many different tools and processes. Oil companies look to the varied tools and processes for abilities to reduce the time it takes to produce hydrocarbons. The options are innumerous: within the subset of options to reduce nonproductive time is the option to reduce drilling time. And within the subset of options for reducing drilling time is to reducing opposing frictional forces. Existing methods and tools that attempt to reduce drilling time by reducing the opposing frictional forces on the drill string and increase the weight on the drill bit include attempts to reduce the static and dynamic friction between the drill string and the surrounding formation, through, e.g., centralizers and vibratory tools. Oil companies utilizing existing vibratory tools attempt to resolve the problem of high nonproductive time by placement of the vibratory tools on the drill string, which add motion in certain directions to reduce frictional resistance. Problems with these vibratory tools include limited range of motion, limited ability to work at variable flow rates and limited ability to avoid interference with monitoring equipment. Moreover, the tools are known to have high pressure drop. A rig can operate at a certain standpipe pressure (SPP). The SPP is the total pressure loss in the system that occurs due to fluid friction, which is the total pressure loss in the annulus, pressure loss in drill string, pressure loss in bottom hole assembly and pressure loss across the bit. These existing vibratory tools contribute excessively to the drill string pressure loss and consequently disproportionately to the SPP. Excessive pressure drop across the tool results in over-stressing other portions of the drilling assembly, or requires reduced mud flow and slower drilling.

As a result, there is a need for an improved vibratory tool that provides for vibration in three axes, is low cost, can increase drilling speed, reduce internal drag forces on the drill string, allow for more efficient energy transfer to the drill bit, that is resilient to formation and drilling conditions, usable in various drilling formations, is reliably operable within a range of fluid pressures, and allows for a minimal pressure drop across the tool.

SUMMARY OF THE INVENTION

The present disclosure teaches a tool that is a three axial vibratory tool that can be placed in a drill string to aid in the downhole drilling process. The three axial vibratory tool enhances slide and rotary drilling operations by causing vibrations in three axes to help overcome static and dynamic friction. In the axis parallel with the tool, the tool is vibrated through shock pressure changes caused by variable fluid flow through opening and closing valves. As a valve opens and closes, fluid including drilling fluid, water, or any other suitable fluid is alternatively allowed to flow and partially prevented from flowing through the device, resulting in sudden sharp changes in pressure across the valve. This shock change in pressure is translated to the rest of the vibratory tool, and consequently to the surrounding drill string, as sudden z-axis (the axis parallel with the drill string) forces and movement. In the axes perpendicular with the axis of the tool (x- and y-axis), an internal eccentric mass is rotated accelerating the tool along those axes as the mass rotates. The mass has a center of mass off center from the centerline of the vibratory tool and is rotated. Rotation of this unbalanced load creates the x- and y-axis vibrations Amplitude and frequency of the exciting vibrations can be controlled through a combination of fluid flow controls and sizing of valves and mass. The vibratory tool can be powered by a rotor-stator assembly that derives its power from drilling fluid or any other suitable fluid forced along the assembly causing the rotor to rotate within the stator and nutate around the several lobes. Through advantageous placement, the rotor rotation can both rotate the valves, causing repeated opening and closing of the fluid path, and power the eccentric mass, causing lateral forces. Because of its durable design, compatibility with drill strings, and usability downhole, the vibratory tool can reduce the time to reach a target depth in drilling by reducing friction between the drill string and the formation and by exciting the bottom hole assembly to improve weight transfer to the drill bit.

BRIEF DESCRIPTION OF THE DRAWINGS

The above-mentioned aspects and other aspects of the present techniques will be better understood when the present application is read in view of the following figures in which like numbers indicate similar or identical elements.

Figure 1:
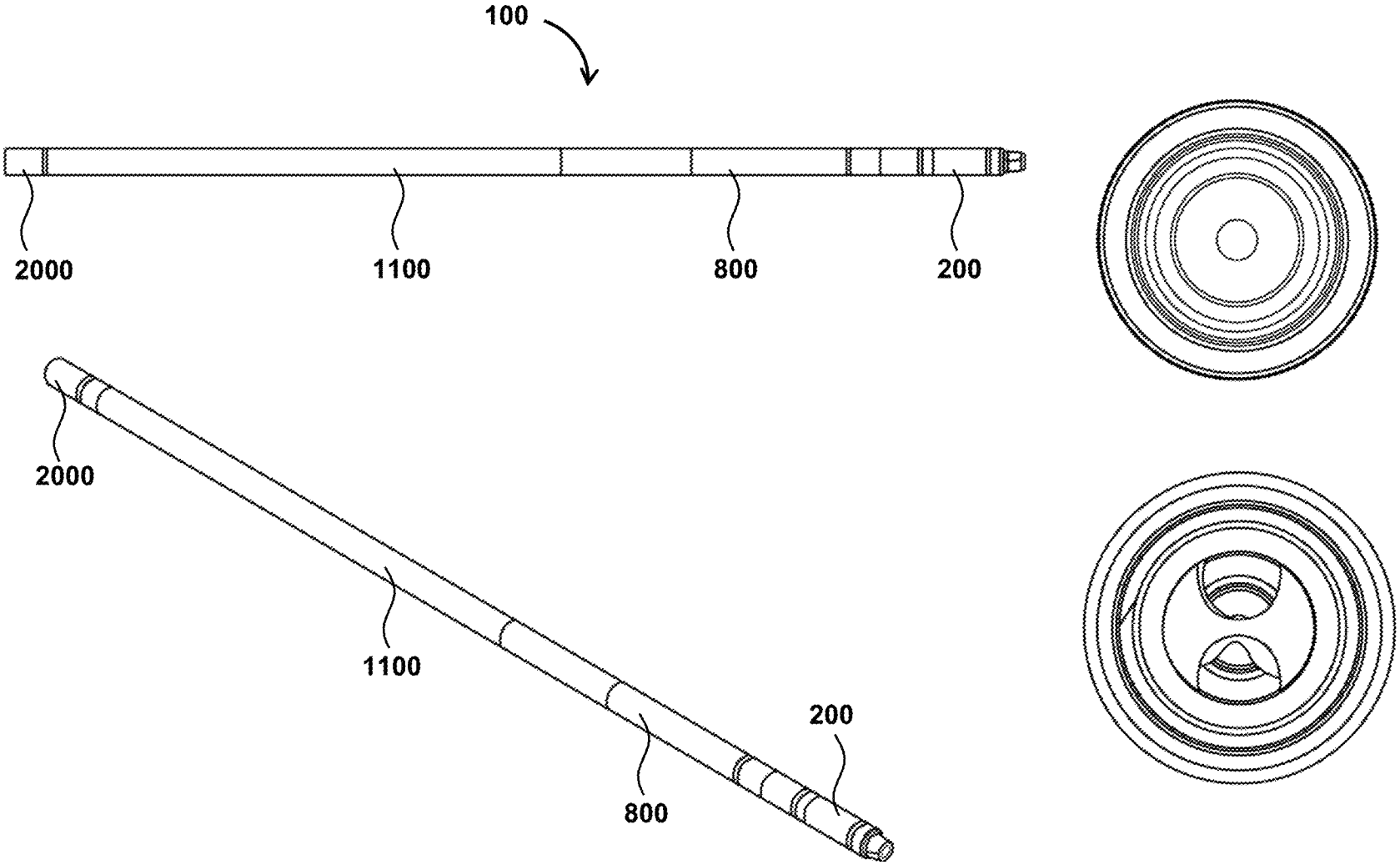
FIG. 1 is an embodiment of the present disclosure, from the side front, back, and orthogonal direction.

Where appropriate, sectional views are included and are to be interpreted as continuous of the designs or patterns shown therein, unless specifically described otherwise. That is, pieces appearing as cylindrical sectioned are to be interpreted as continuing cylindrical shape throughout. Where there is conflict in interpretation of a sectional view and a more complete view, the more complete view should be assumed to control. Where there is a conflict in interpretation of a written description and a figure, the written description should be assumed to control. Where descriptions are of geometric or spatial terms, strict mathematical interpretation of those terms is not intended.

While the invention is susceptible to various modifications and alternative forms, specific embodiments thereof are shown by way of example in the drawings and will herein be described in detail. The drawings may not be to scale. It should be understood, however, that the drawings and detailed description thereto are not intended to limit the invention to the particular form disclosed, but to the contrary, the intention is to cover all modifications, equivalents, and alternatives falling within the spirit and scope of the present invention as defined by the appended claims.

DETAILED DESCRIPTION OF CERTAIN EMBODIMENTS

To mitigate the problems encountered in downhole drilling as described herein, the inventors had to both invent solutions and, in some cases just as importantly, recognize problems overlooked (or not yet foreseen) by others in the fields of vibratory tools, hydrocarbon extraction, drilling, and drilling solutions. Indeed, the inventors wish to emphasize the difficulty of recognizing those problems that are nascent and will become much more apparent in the future should trends in hydrocarbon extraction industry continue as the inventors expect. Further, because multiple problems are addressed, it should be understood that some embodiments are problem-specific, and not all embodiments address every problem with traditional systems described herein or provide every benefit described herein. That said, improvements that solve various permutations of these problems are described below.

Certain embodiments of the present disclosure include a linearly arranged vibratory tool that is attachable on a drill string for use in downhole hydrocarbon extraction such as oil and gas production. In the preferred embodiment, the components of the vibratory tool are arranged in a substantially cylindrical manner to fit within a cylindrical space, including a wellbore or a casing joint and constructed to allow for attachment to surrounding drill pipe through, for example, threaded ends.

The vibratory tool can be arranged as various portions from fore to aft in some embodiments with some or all of the following components, with the fore portion being the portion intended to be placed furthest into the wellbore and the aft portion being the portion most near the surface. In many embodiments each the fore end and the aft end is connected to the drilling string or to other appropriate tools for drilling. In a preferred embodiment, the vibratory tool is arranged as in FIG. 1. Toward the fore portion of the vibratory tool is the axial shock assembly or valve assembly 200, including stationary and rotating mounts and inserts to allow drilling fluid flow through the central bore of the vibratory tool. The mounts and inserts are each valve plates. The valve plates are housed within a valve housing that is adapted to fasten to the drill string, including drill pipe, forward, i.e. down hole, of the vibratory tool. This adaptation can include threads for screwing the vibratory tool onto the drill pipe. This portion is at times referred to as the axial shock assembly or the valve assembly. Aft of the valve assembly is the eccentric mass assembly 800. The eccentric mass comprises a component with pronounced asymmetry along the centerline of the vibratory tool. It is designed to rotate about the centerline of the vibratory tool such that as the eccentric mass rotates, the net result is a net inertial force directed away from the axis of rotation of the eccentric mass. With a high number of revolutions per minute, the mass, and the vibrating tool more largely, is constantly being displaced and moved by these asymmetric forces in the direction of the inertial forces, perpendicular to the axis of rotation of the eccentric mass. It is this repeated displacement that cause a vibration of the vibratory tool and the drill string more broadly along the x- and y-axes. This portion is at times referred to as the lateral vibration assembly. Aft of the eccentric mass is the rotor-stator assembly 1100 that serves as the power section, and the rotor-stator assembly 1100 is sometimes referred to as the power section 1100. The rotor is an extended member with a plurality of lobes helically and advantageously shaped to fit within a stator with one more similarly helically arranged recesses or lobes than the rotor. The recess or lobes of the stator are arranged to receive the lobes of the rotor as it rotates and nutates within the tool. The power section relies on hydraulic power from the drilling fluid passing through the cavity formed between the rotor and the stator. As the drilling fluid flows in this cavity, the hydraulic pressure forces the rotor to rotate around its axis and nutate around the lobes of the stator. The stator elastomer is housed in its casing and bonded with the stator tube to prevent delamination. In certain embodiments, the rotation of the rotor in turn rotates the drive shaft which is connected, aft to fore in series, to a constant velocity shaft, the eccentric mass, a second drive shaft, and the rotating valve. In this manner, the rotor/stator assembly is the power section for both the x- and y-axes inertial vibration and the z-axis shock vibration. Aft of the rotor/stator assembly is the top sub 2000, which is shaped to connect with the surrounding drill string aft of the vibrating tool, typically through a threaded connection. In many embodiments, each of the valve assembly, the eccentric mass assembly, and the rotor-stator assembly are substantially cylindrical portions of the tool with circular cross sections.

Figure 2A:
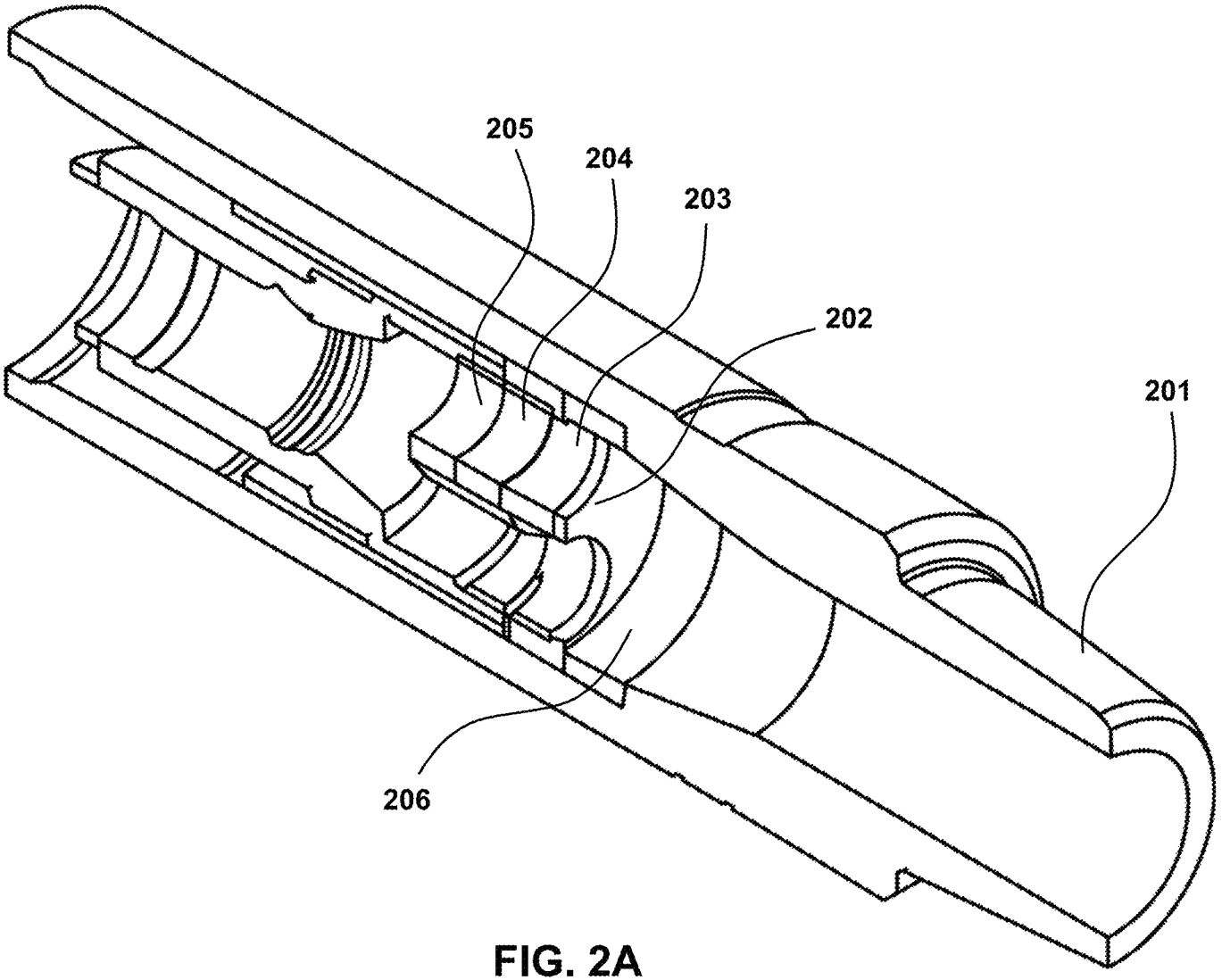
FIG. 2*a* is an orthogonal sectional view of the valve assembly portion of an embodiment of the present disclosure.
Figure 2B:
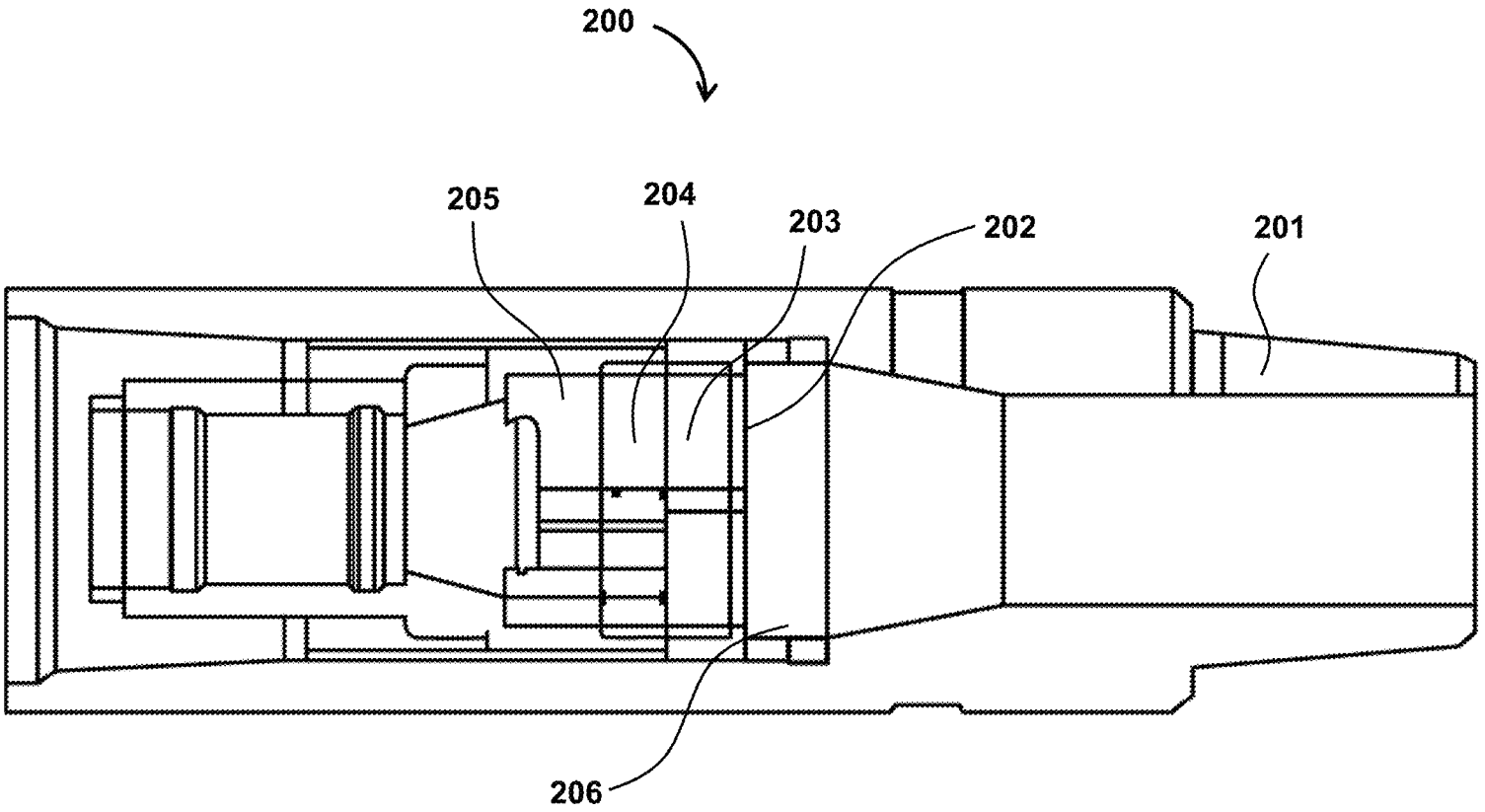
FIG. 2*b* is a side sectional view of the valve assembly portion of an embodiment of the present disclosure.
Figure 3:
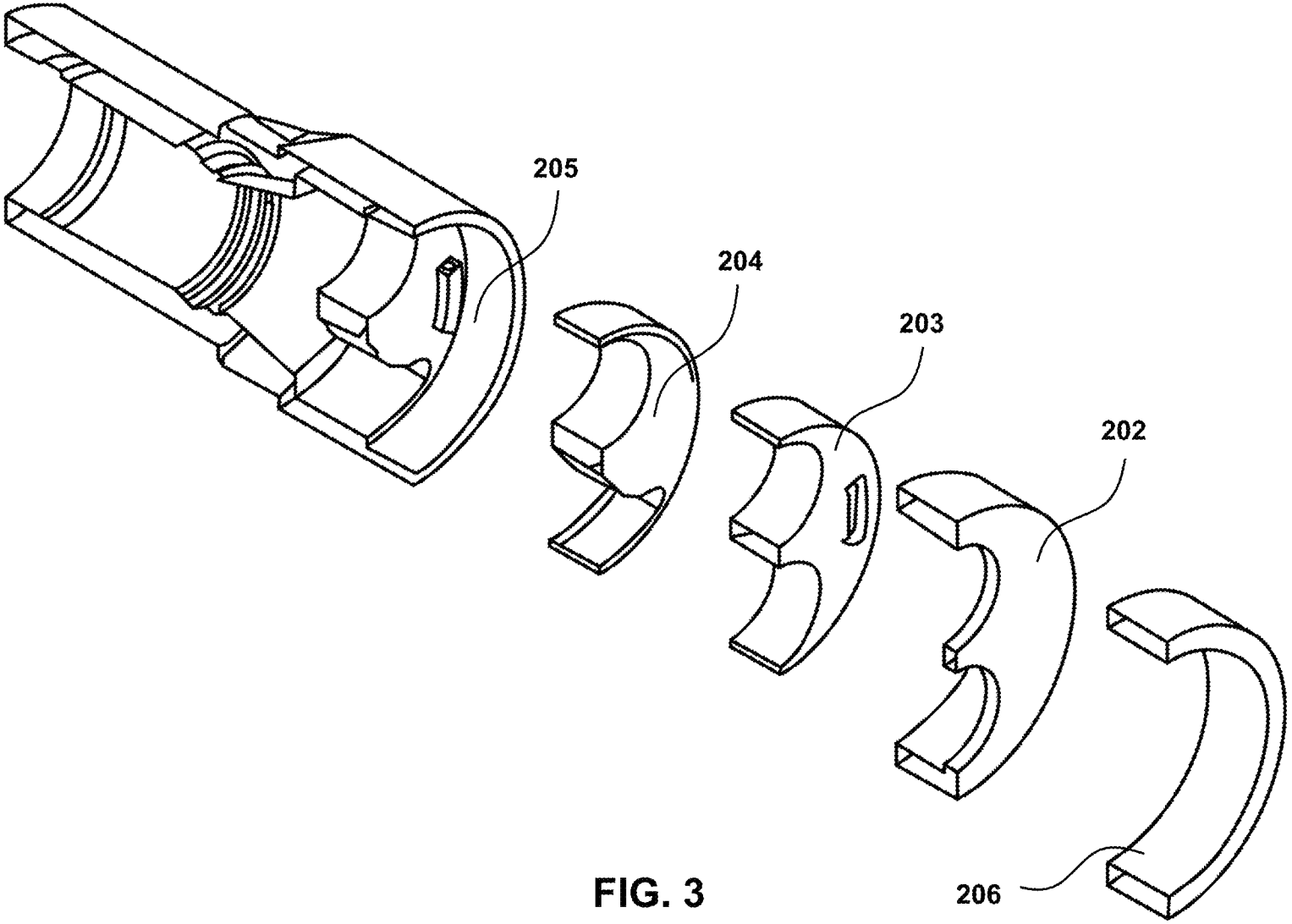
FIG. 3 is a sectional view of the valve assembly, exploded.
Figure 4:
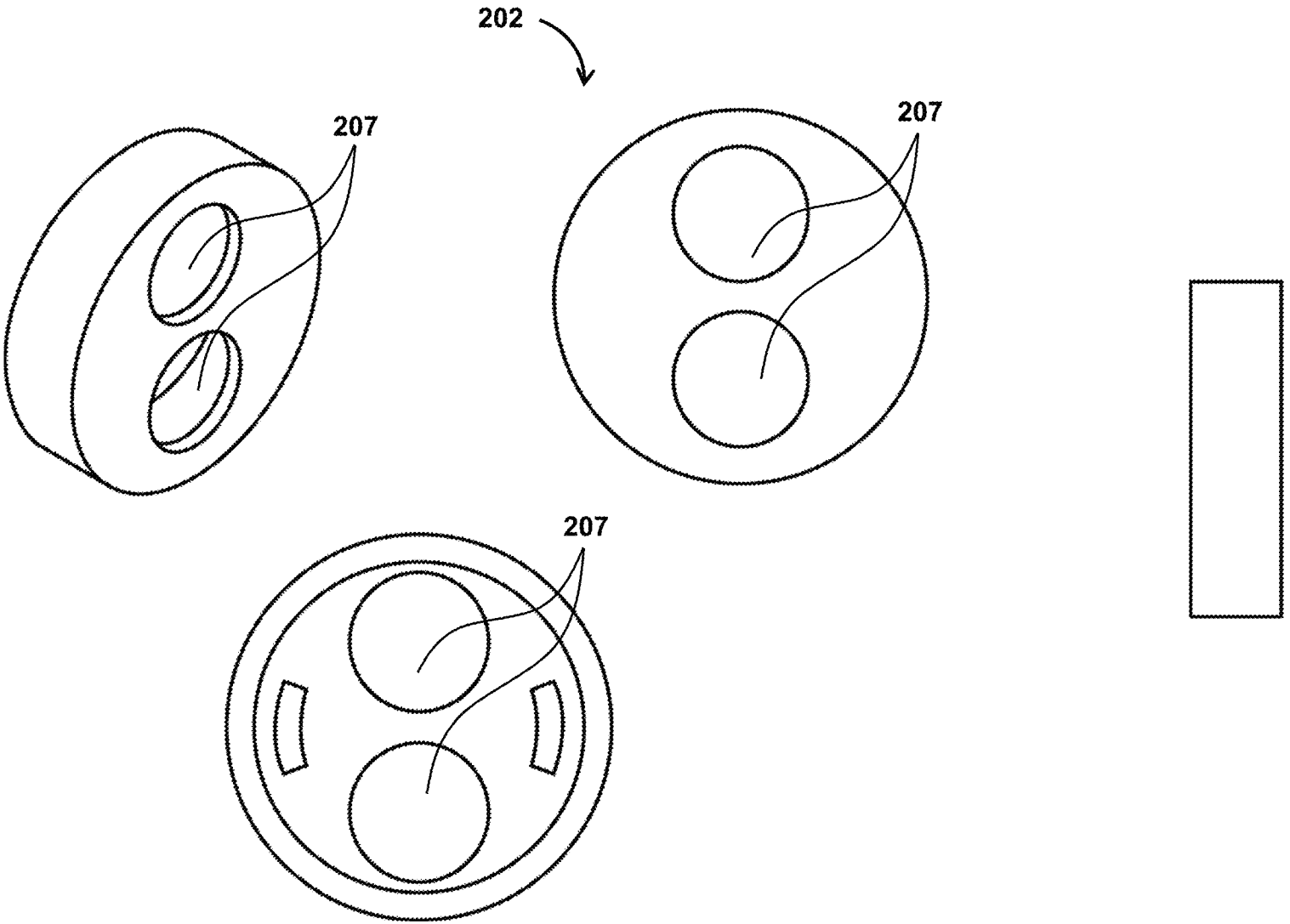
FIG. 4 shows multiple views of the stationary plate mount, including an orthogonal view, a side view, a front view and a rear view.
Figure 5:
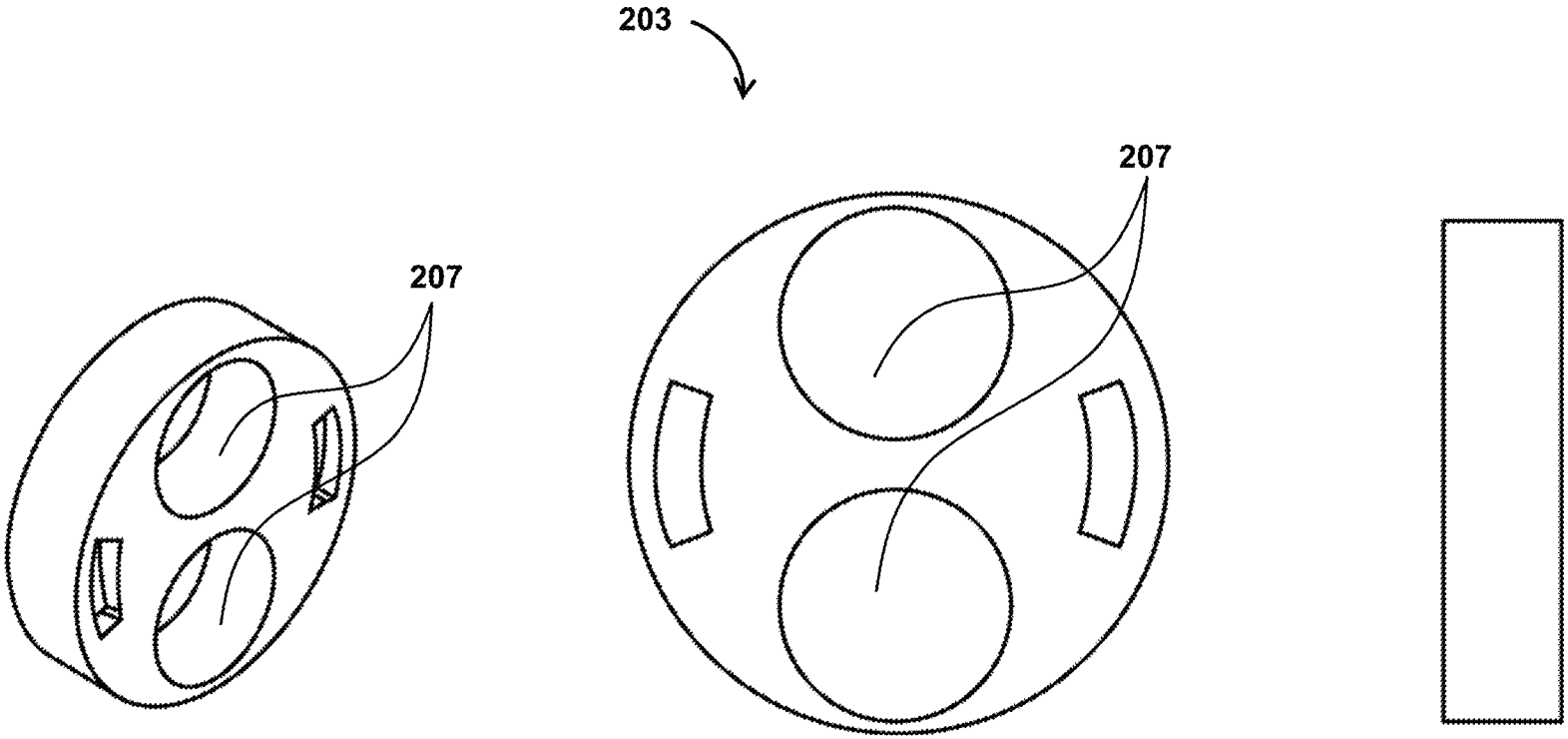
FIG. 5 shows multiple views of the stationary plate insert, including an orthogonal view, a side view, and a front view.
Figure 6:
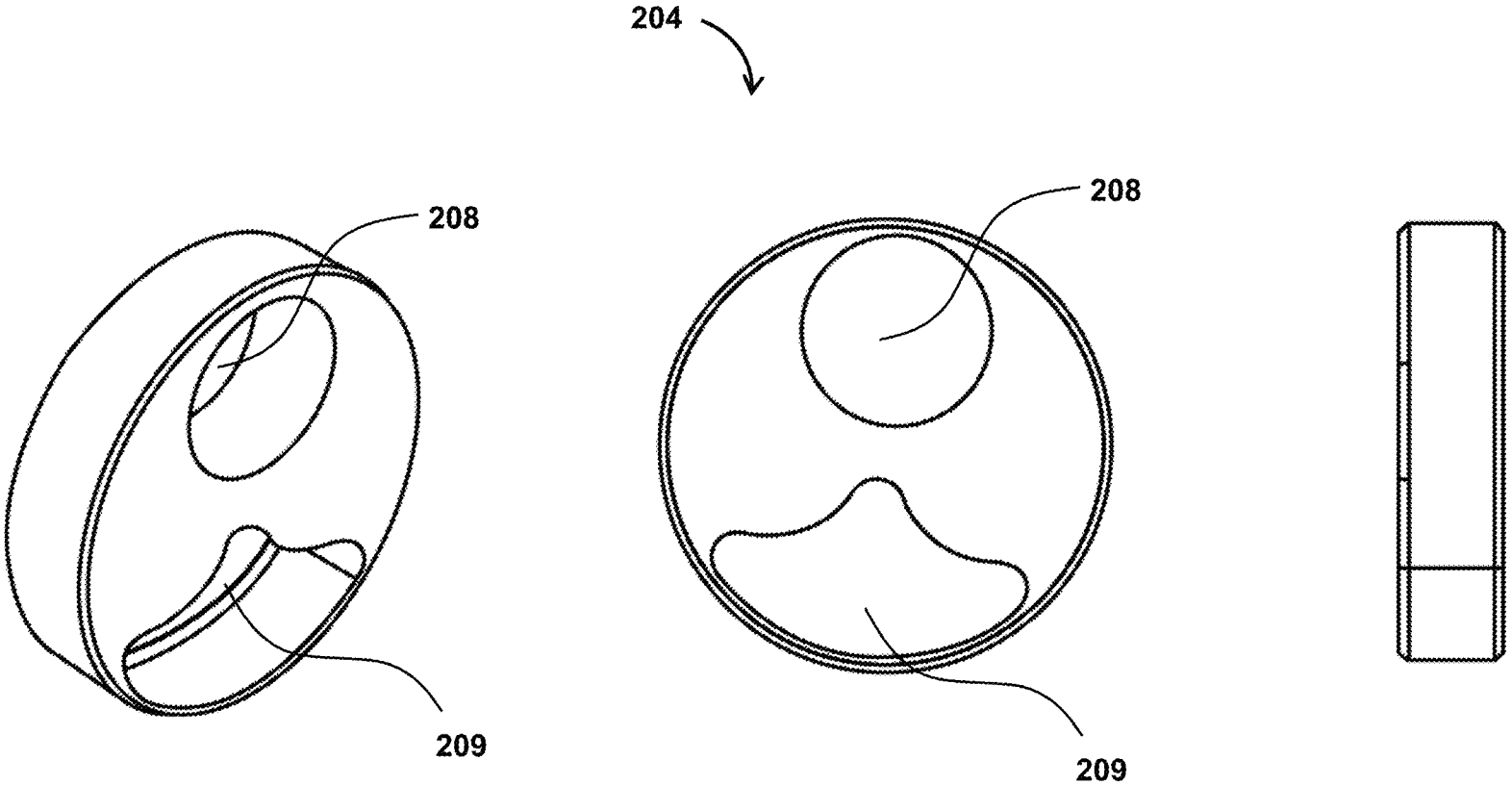
FIG. 6 shows multiple views of the rotating plate insert, including an orthogonal view, a side view, and a front view.
Figure 7:
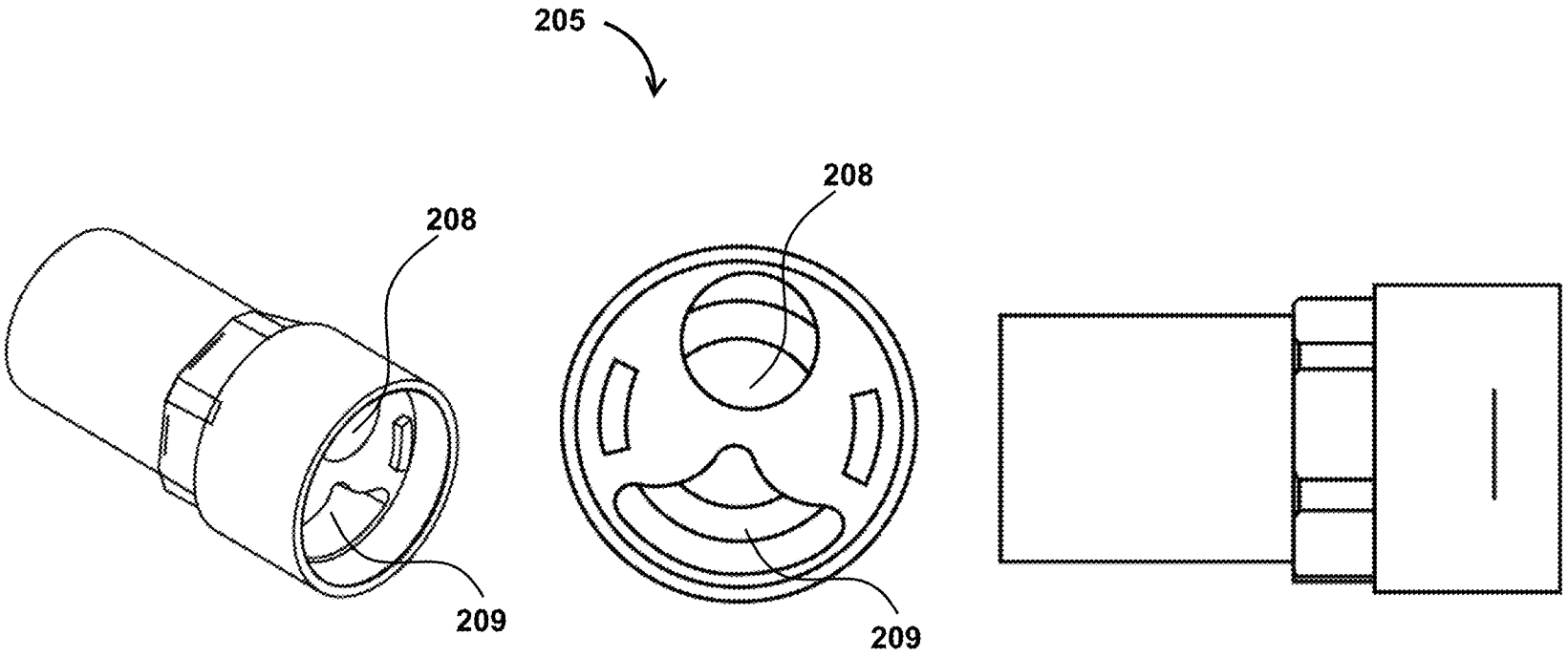
FIG. 7 shows multiple views of the rotating plate mount, including an orthogonal view, a side view, and a front view.
Figure 14B:
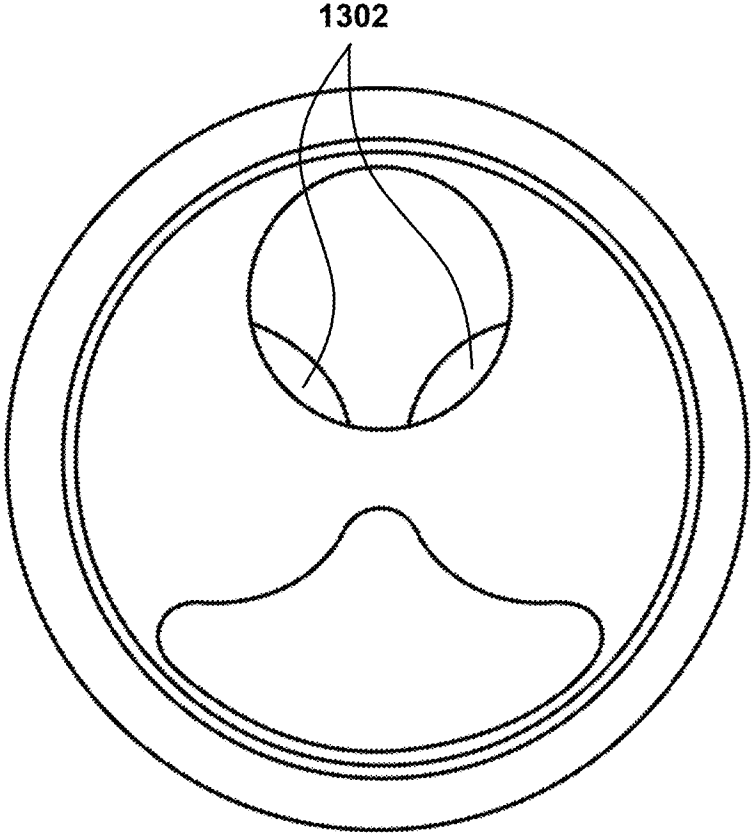
FIGS. 14*a* and 14*b* show the rotating valves in their open-most and close-most configurations.
Figure 14A:
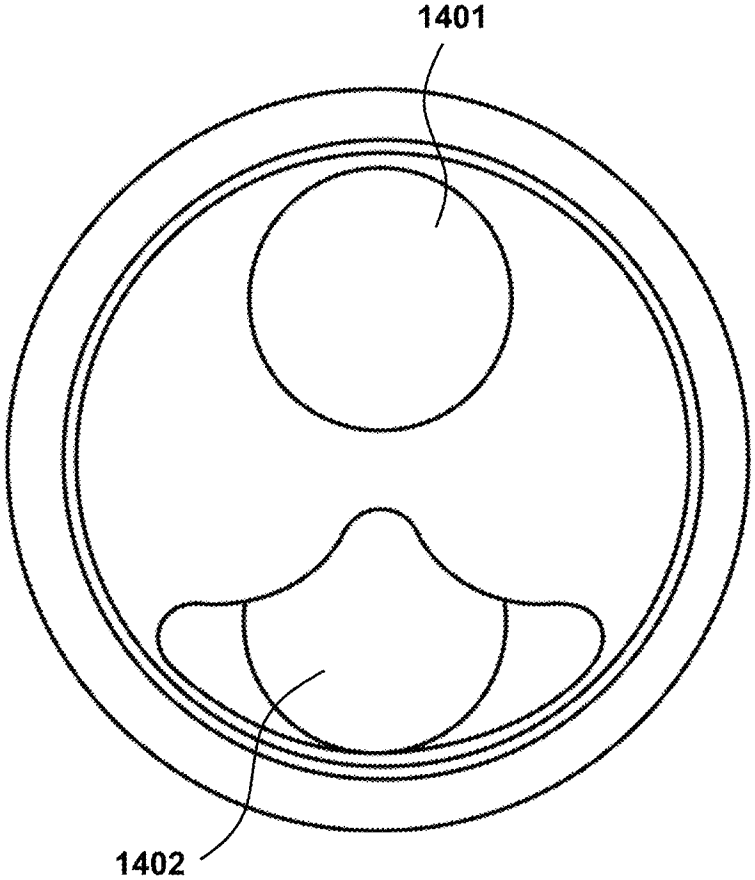
Figure 15:
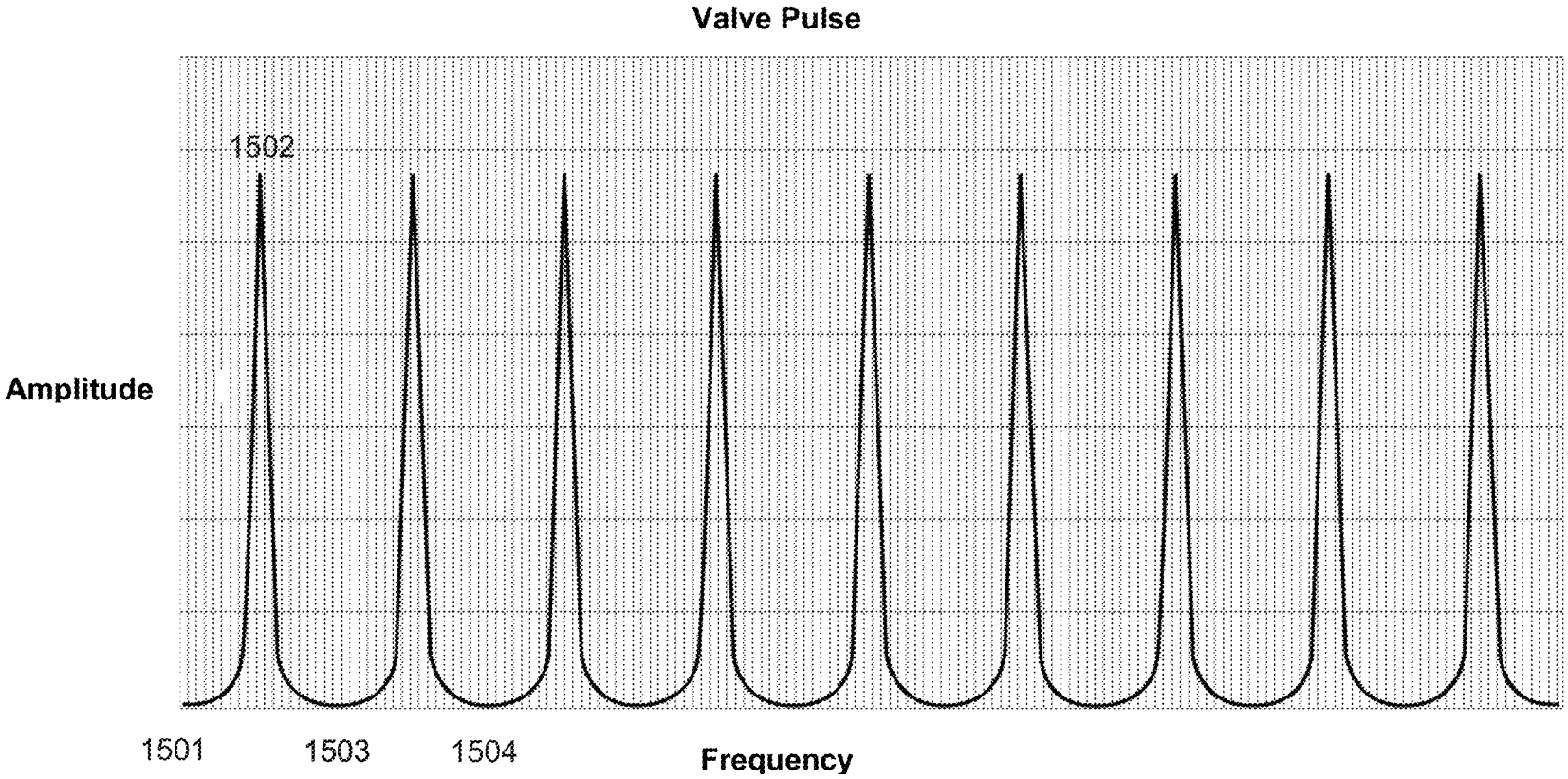
FIG. 15 shows percussive shock forces and low troughs caused by the repeated opening and closing of valves.

Percussive forces are advantageous in drilling and movement of a drill string through a formation. Percussive affects can be caused by sharp variations in fluid flow through the vibratory tool, resulting in pressure spikes. Pressure changes across the vibratory tool are enhanced by regulating fluid flow through the vibratory tool. In certain embodiments, fluid flow is increased and lessened by the interaction of a valve created by the interactions of a rotating plate and a stationary plate, with advantageously located cut-outs to allow flow through. A section of one embodiment of the valve assembly is shown in FIGS. 2*a* and 2*b*. As shown in these figures, from fore to aft is the valve housing 201, encasing the entirety of the valve assembly. Within the valve housing is the stationary plate mount 202. Aft of stationary plate mount 202 is the stationary plate insert 203. Aft of the stationary plate portions are the rotating plate insert 204 and the rotating plate mount 205. In certain embodiments, a spacer 206 is needed for proper placement of the rotating plates within the housing 201. FIGS. 2*a* and 2*b* show the valve assembly 200 in a sectioned side and orthogonal view. FIG. 3 shows an orthogonal view of the four-plate valve assembly with the additional spacer, exploded to show the axial alignment and arrangement of this embodiment of the vibrating tool, with like numbers indicting like components of the valve assembly. As shown in the embodiment of FIGS. 4, 5, 6, and 7, each portion of the valve assembly is generally circular in cross section to fit within the cylindrical housing and fitted with two cut-outs, accounting for such other parts of the tool and for flow of other fluid or drilling mud. In the embodiment shown, the cutouts are not necessarily arranged circumferentially symmetric about the centerpoint of the valve plates. It will be understood by the reader that a variety of cutouts within the valve can substantially provide the flow and pressure profiles necessary for the needs of the present disclosure. The stationary valve set have two oppositely located circular cutouts 207. The rotating set have a circular cut out 208 and another cut-out 209 approximately fan-shaped to complement the solid (that is, uncut) portion on the stationary plates when the holes of the stationary plate are rotated at a 90° angle from the position in which the circular portions of the two-set overlap. Preferably, the flow is managed by rotating one plate and keeping the other stationary. FIGS. 14*a* and 14*b* show a reverse view (aft to fore) of the valve plates as assembled in this embodiment and demonstrates in one embodiment the interaction between the valve plates as they rotate, showing a preferred embodiment in which the two most extreme positions of the valves. In that embodiment and with reference to the pass-through section numbering of FIGS. 4 through 7, FIG. 14*a* displays the topmost circular cut out of each valve plate, 207 and 208, overlapping, causing large pass-through area 1401 for drilling fluid. In this position, the two circular pass-through areas 207 and 208 are axially concentric. The opposing openings 207 and 209 also have their largest overlap, causing a second pass-through area 1402. In this configuration, the midlines of opposing openings 207 and 209 lie on the same axial plane. This is the open-most configuration for that embodiment. As shown in the embodiment of FIG. 14*b*, the overlap between the rotating valve plate and the stationary valve plate is minimal in this state. Only a small percentage of the drilling fluid can pass through the vibratory tool in the overlap areas 1302. In this configuration, the bottom opening 209 of the valve plate 204 nearest the viewer does not allow any fluid to pass through because of the complete overlap with a solid portion of the plate 203 most distant the viewer. In most embodiments, it is advantageous to continue to allow some fluid flow through the valves regardless of valve position to reduce the pressure drop across the entire vibratory tool and to allow consistent power generation, which relies on continuous drilling fluid to pass through the power section. Thus, in these embodiments, the valves never completely close. An exemplary axial pulse caused in some embodiments by this valve arrangement is shown in FIG. 15, where the shock is shown in the high amplitude of each pressure pulse, approximately corresponding to the valve arrangement shown in FIG. 14*b* at a conceptual level. The low-pressure periods correspond to the high-flow periods, with the trough approximately corresponding to the open-most configuration of the valves in 14*a*. Because the power generation of this embodiment comes from the rotor/stator aft of the valve assembly, the rotating valves will be aft of the stationary valves to allow for connection between the rotating power source and the to-be rotated valves. In other embodiments, each of the plates could be rotating or translating in any other suitable way as to allow intermittent flow through the plates. Other embodiments include any suitable method for generating intermittent or pulsating pressure changes. The preferred pressure graph generated by the pulsing is one with pronounced spikes and low valleys as opposed to more sinusoidal pressure output. The sudden forces associated with spikes has been found to optimize drilling ability, optimate weight to drilling bit, and optimally avoid static friction scenarios. As shown in FIG. 15, the intermittent flow allows for sudden, high-pressure spikes and a rapid, post-spike return to low pressure. In a preferred embodiment, the valves are carbide compounds. In a preferred mode, the vibratory tool is used with a shock sub above the vibratory tool to attenuate the percussive forces upward of the vibratory tool. In some modes, the vibratory tool is used with a shock sub both above and below the vibratory tool to attenuate percussive forces in both directions. The reader will understand that the preferred embodiment is one of many ways to arrange the valves and to design the valve assembly to provide sudden sharp pressure spikes and more extended low-pressure periods.

Figure 16:
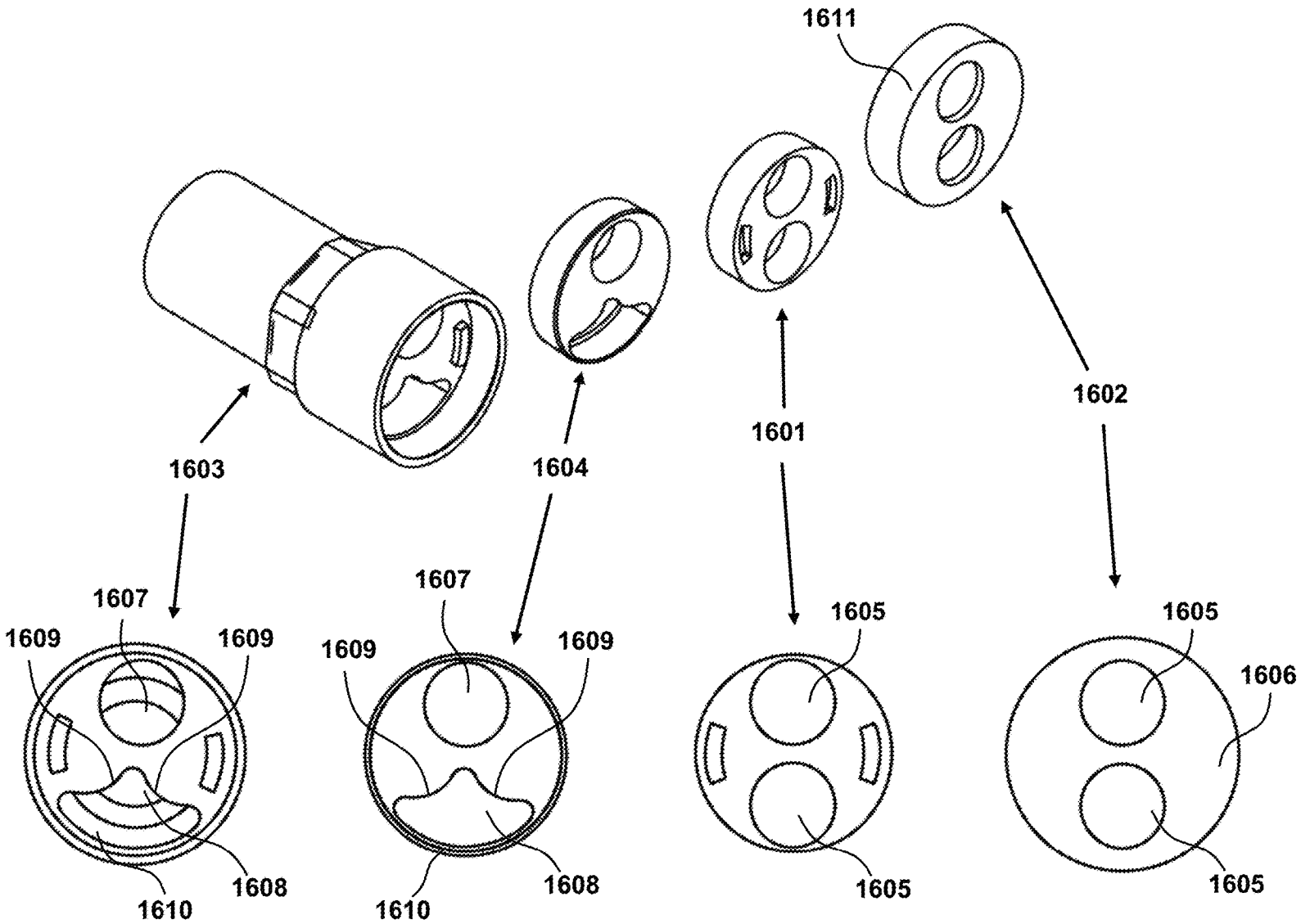
FIG. 16 shows a disassembled embodiment of the four parts of the valve assembly from an orthogonal view and a front view.

In a preferred embodiment, shown on FIG. 16 the valve is comprised of four different pass-through pieces, a stationary plate insert 1601 and a stationary plate mount 1602 each with twin circular pass through sections, and a rotating plate mount 1603 and rotating plate insert 1604 each with one circular and one fan-shaped pass through section. At times, the stationary plate mount 1602 and stationary plate insert 1601 are collectively referred to as the stationary valve, and the rotating plate mount 1603 and rotating plate insert 1604 are collectively referred to as the rotating valve. Each of the four pieces when assembled are axially and concentrically arranged abutting each and with one or more capable of rotational motion about the longitudinal axis of the vibratory tool. With respect to the two valves 1601 and 1602 with twin circular pass through sections, the body 1606 is generally circular. Each of the two pass-through sections 1605 are substantially identical. They are positioned on opposite sides of the center-point of the circular body 1606. Each circular pass-through section 1605 of the stationary plate mount 1603 has a diameter of approximately one-third of the diameter of the body section 1606. Because the stationary plate insert has a smaller diameter, as needed to fit within the stationary plate mount 1602 and its outer wall 1611, the pass-through sections 1605 of the stationary plate insert 1601 are a greater fraction of its overall diameter. In this embodiment, the spacing between the edge of the body sections 1606 and the edge of a pass-through section 1605 is approximately one-third of the diameter of the pass-through section 1605, and the spacing between the two pass-through sections is approximately one third of either of the pass-through sections. In this manner, the face of the stationary valve plate 1602 allows for approximately 22% of the total area to serve as a pass through, and correspondingly approximately 77% of the area interior of the edges of the valve plate 1602 face is solid. The smaller diameter stationary valve plate insert 1601 allows for approximately 36% of its total area to serve as a pass-through, or about 64% is solid. The rotating plate mount 1603 and rotating plate insert 1604 valve pieces each have circular 1607 and fan-shaped 1608 pass-through areas. The circular pass through areas 1607 are arranged in both size and position such that it has substantially complete overlay with one of the circular pass-through areas 1605 of the other valve plates 1601, 1602 when fully assembled. The fan-shaped pass through areas 1608 are substantially formed by three large radius arcs. The largest arcs 1610 are substantially concentric with the valve plates 1603 and 1604 themselves and has a central angle of approximately 90°. Each of the two smaller arcs 1609 are sized with substantially the same radius as the pass-through sections of the other plate and symmetrically positioned about the larger arc such that their center-points are located on the same diameter of the valve plate itself. In this arrangement, the solid area of the valve plate will be well shaped such that when aligned with the valve plate 1601, 1602 with two identical circular pass-through areas and rotated 90°, the pass through areas 1605 will substantially align with the smaller arc 1609. Each of the three above-mentioned arcs are connected with smaller arcs or circular sections, each with radius in this embodiment of approximately $1/5^{th}$ of the larger arc radius.

The pass through sections of the stationary plate insert 1601, stationary plate mount 1602, rotating plate mount 1603, and rotating plate insert 1604 vary in different intended deployments to account for different drilling mud weights intended to be used. In each of these preferred embodiments, the orientation and shape of the pass throughs sections are as shown in FIG. 16, but in those varied embodiments, more or less of the total area of the plate inserts and plate mounts faces are cut outs and allow pass-through of drilling fluid.

Figure 17:
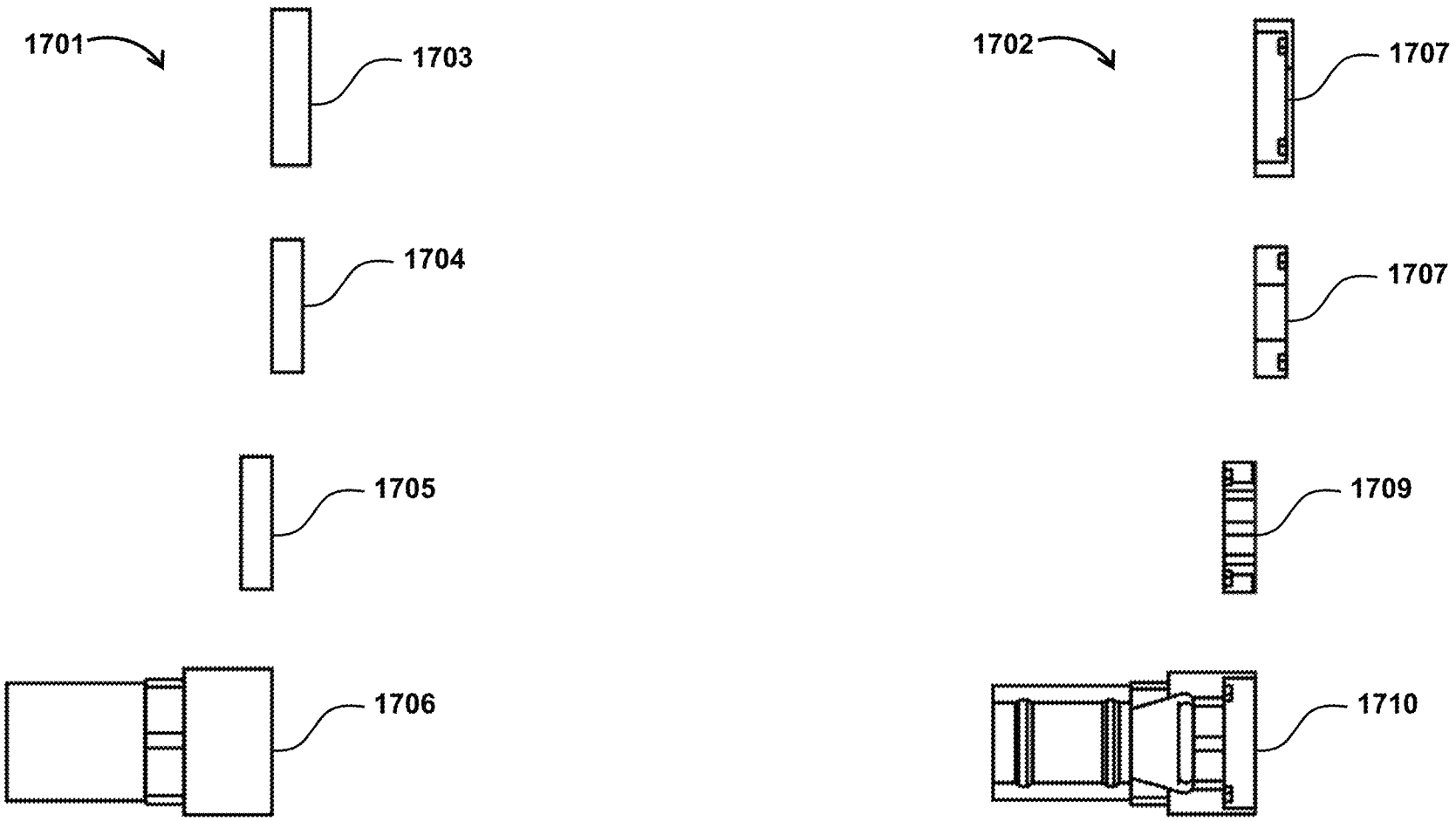
FIG. 17 shows a disassembled valve assembly from a side view and a side sectional view, with each peace transposed laterally while retaining its approximate z-axis position in the fully assembled state.

With respect to FIG. 17, an exploded view of this embodiment of the valve assembly 1701 is shown, with correspondence cross sectional views 1702. The drawings, like all drawings in this application, are not necessarily to scale, but the pieces have been transposed in the vertical direction in this FIG. 17. As a consequence, it is apparent that the rotating plate mount 1706, 1710 house the rotating plate insert 1705, 1709, the stationary plate mount 1703, 1707 house the stationary plate insert 1704, 1707, can enter into and out of alignment to allow pass through of drilling fluid, such as drilling mud, or other fluid.

Figure 18:
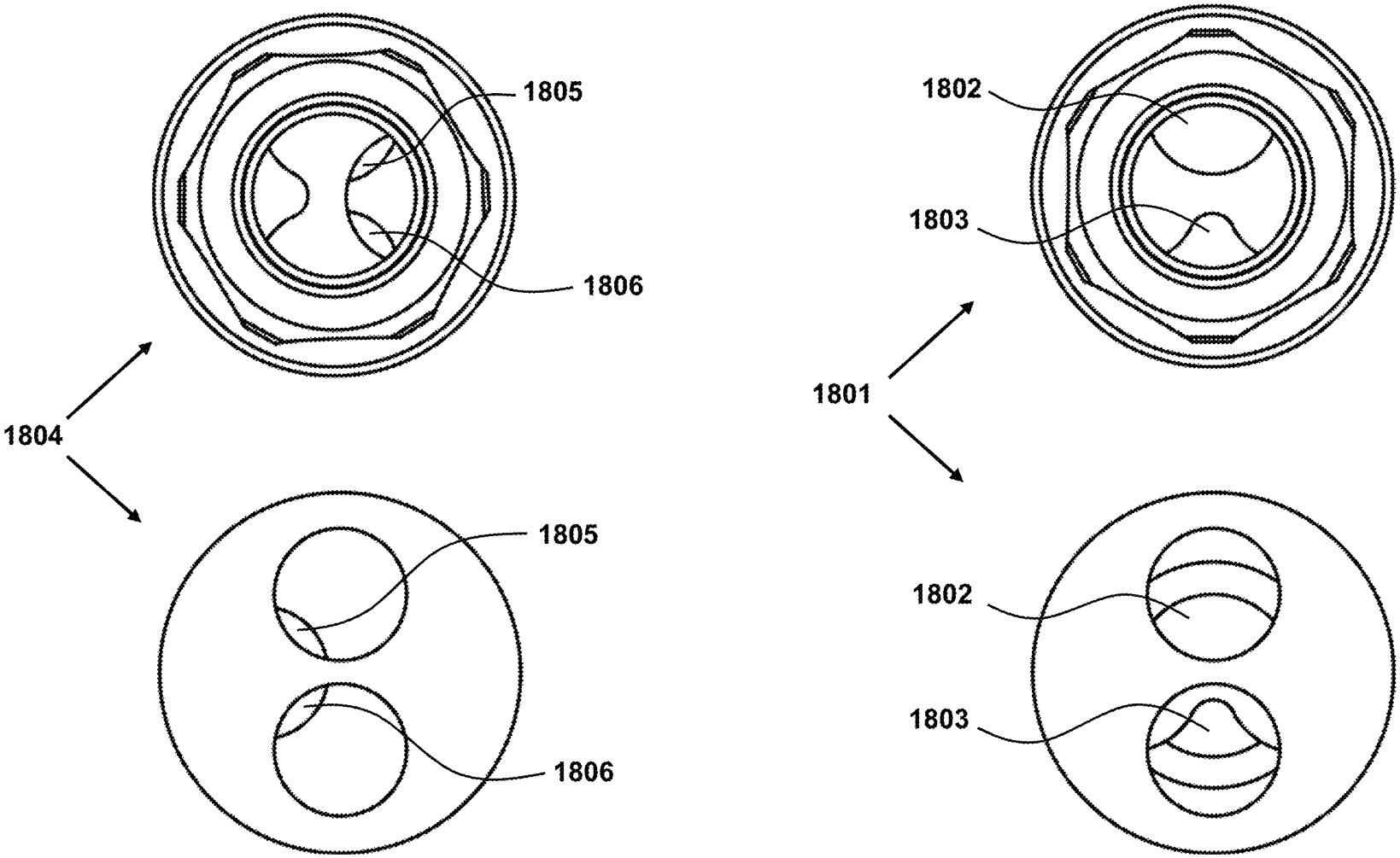
FIG. 18 shows an assembled valve assembly from the front view and the back view in the closed-most state on the left and an assembled valve assembly from the front view and the back view in the open-most state on the right.

With reference to FIGS. 18 and 16, in the embodiment shown, the pass-through area of the assembled valve is substantially lower than the above-listed percentages for the valve plates individually even in the most wide-open alignment 1801 because the combined assembled upper pass-through section 1802 and lower pass-through section 1803 of the full assembly are smaller than the pass through sections of the individual valve plates. With respect to the closed-most position of the valve 1804, only the circular pass-through sections of the rotating plate mount 1603 and rotating plate insert 1604 valve pieces overlaps with pass-through sections of the stationary plate insert 1601 and stationary plate mount 1602, allowing for very small, but greater than zero pass-through sections 1805 and 1806 of the assembled part 1804. The fan-shaped pass-through section 1608 is substantially completely covered by the body 1606 of the stationary plate pieces 1601 and 1602, allowing for substantially no pass through of the assembled part in this embodiment. Note that, with respect to the wide-open valve alignment 1801 the total pass-through area is larger than what is visually apparent from a frontal view of the assembly because with respect to FIG. 17, there is a frustoconical surface 1711 on the rotating plate mount, apparent in the cross sectional views 1702 of the rotating plate mount 1710. In the embodiment shown, in the wide-open valve state, the overlay 1402, 1803 of the fan-shaped pass through area 209 and the circular pass through area 207 allows for a total pass through area of approximately 88% of the total area of one of the circular pass through areas 207. In the closed most-position, the total pass through area 1302, 1805, 1806 is approximately 12% of the total pass-through area of one of the circular pass-through areas 207. Given that in the open-most position one of the one of the circular pass-through areas has complete overlap and the other has approximately 88% overlap with the fan-shaped pass-through area, the open-most position allows for approximately 188% of a single circular pass-through area. The ratio in this embodiment from peak flow to most restricted flow through the valve is approximately 16:1. Other embodiments can similarly provide adequate axial shock when the valves are sized to restrict fluid flow at a ratio of 10:1 on the low end to an unbounded ratio (i.e., completely restricted flow when closed) on the high end. Given tolerances, manufacturing needs, downhole conditions, and accompanying tool strength and design, the described embodiment will function substantially the same if, in the closed-most position, the total pass-through area 1302, 1805, 1806 is 8-16% of the total pass-through areas of one of the circular pass-through areas 207 and the open-most position allows for 170-195% of a single pass-through area. In the described embodiments, the total pass-through area increases and decreases during rotation non-linearly throughout the rotation of the valves. It will be understood that the percentages listed herein are approximate and are dependent on the specifics of the valve pass-through areas chosen in the embodiment used. It is within the contemplation of this disclosure to utilize a variety of pass through shapes and orientations to provide different thrust forces appropriate for the tool design, usage, and materials of a particular embodiment of a vibratory tool.

Figure 19:
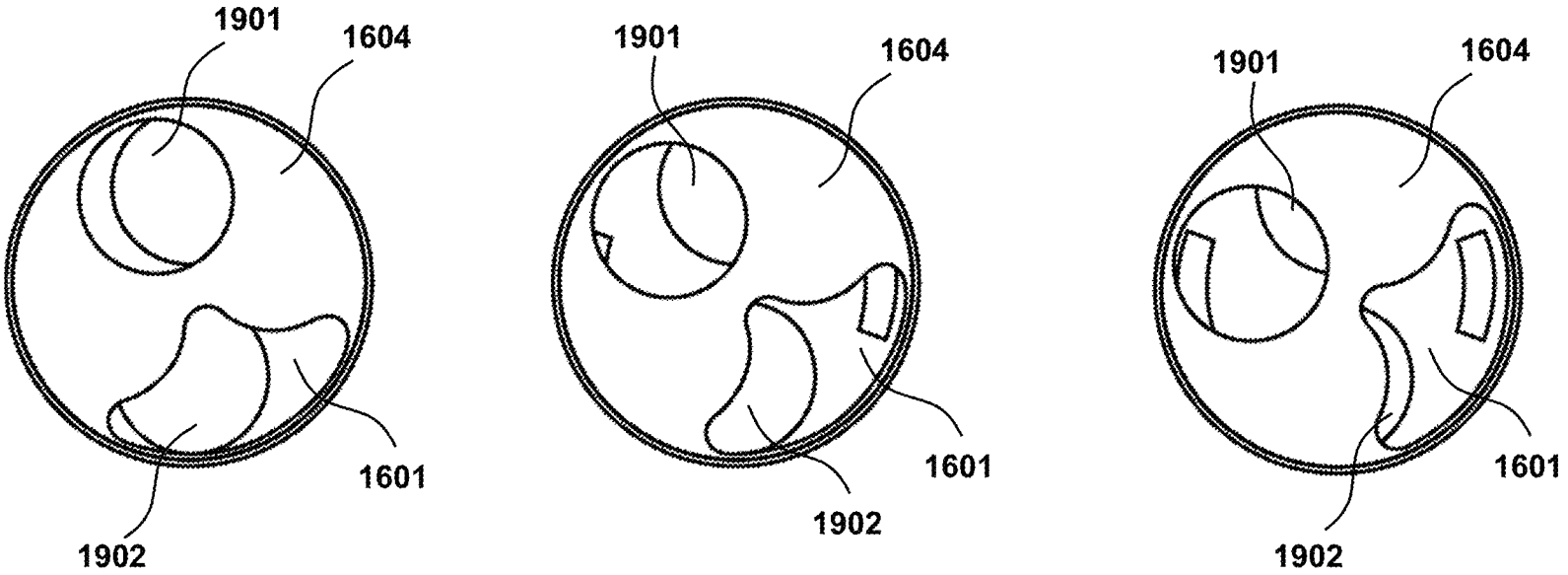
FIG. 19 shows an embodiment of the rotating valve plate rotating over three states between the open-most state and the closed most state of the valve.

With respect to FIGS. 18 and 19, it is apparent that in this embodiment the size of the pass-through sections varies from the wide open position 1801 to the closed-most position 1804 as the rotating plate insert 1604 rotates and the stationary plate insert 1601 remains stationary. FIG. 19 shows three positions the valve can take as the rotating plate insert 1604 rotated approximately 22.5°, 45°, and 67.5° off of the open-most position 1801. This allows for a repeated increase and decrease in fluid flow through the pass-through sections, the resultant pressure changes, and the ultimate axial vibration.

Figure 20:
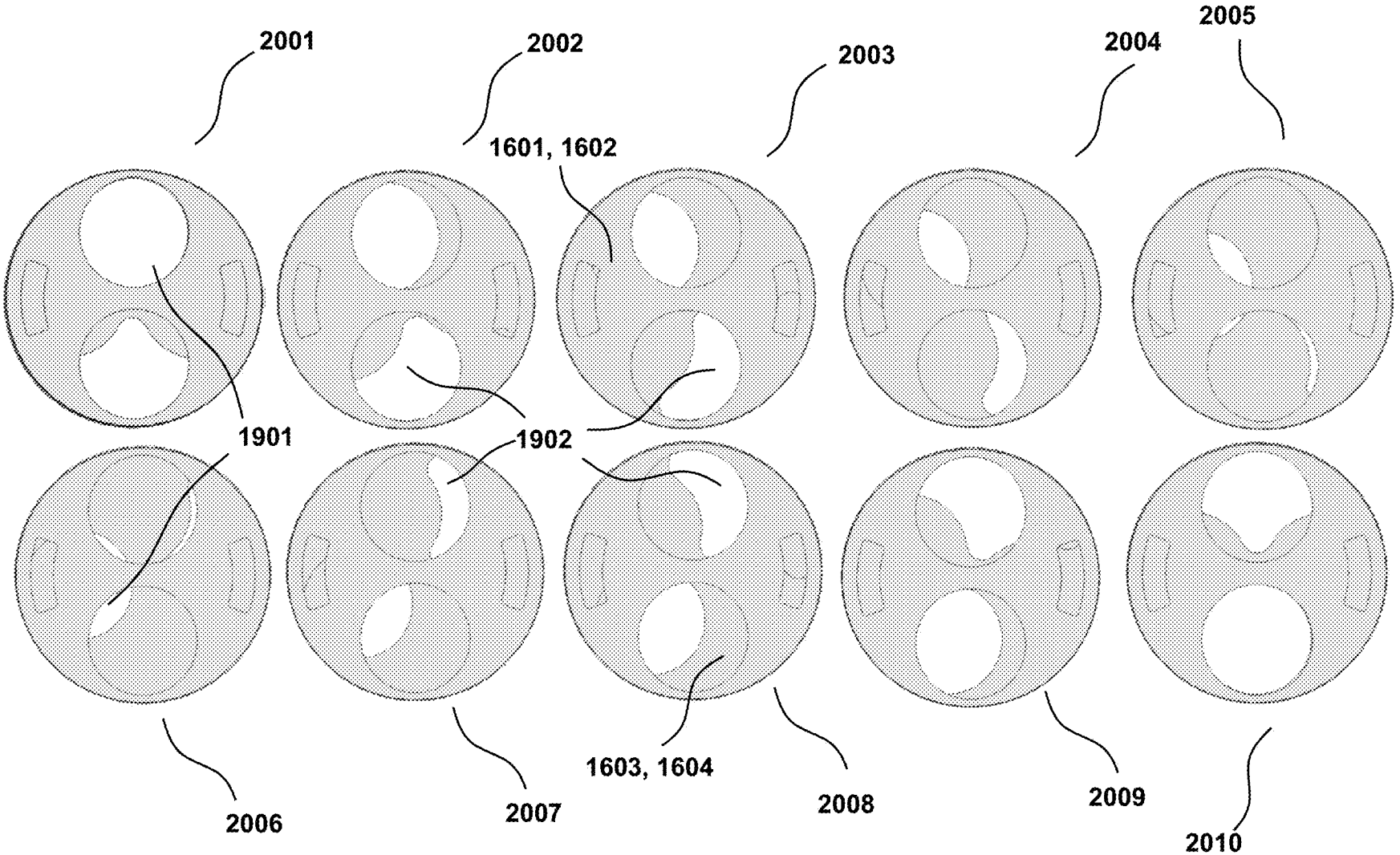
FIG. 20 shows, in one embodiment, the rotation of the valve at 20° increments through 180°.

Both substantially larger and smaller pass-through areas are contemplated in this disclosure. Additional pass-through areas and differently positioned pass-through areas are contemplated in this disclosure. Of greatest effect on the valve function is the ability to create flow patterns of high flow followed by restricted flow such that resultant pressure rapidly spikes and rapidly drops instead of gradually increasing and decreasing. The percussive effect in these embodiments of the tool is a result of drilling fluid alternately passing through and being restricted by the valve assembly, comprising the stationary plate insert 1601, stationary plate mount 1602, rotating plate mount 1603, and rotating plate insert 1604. The rotating plate mount 1603 and rotating plate insert 1604 rotate with respect to the stationary plate insert 1601 and stationary plate mount 1602. As they rotate, as shown in FIGS. 19 and 20, a regular pattern of opening and closing the total pass through sections is apparent in this embodiment. This results in repeated pressure spikes and troughs throughout the tool, to be transmitted on the drilling string, shown in conceptual form in FIG. 15. In turn, this reduces the drag on the drilling string, allows for additional weight on the bit, and reduces and friction opposing rotational forces on the drilling string. In the embodiment shown in FIGS. 19 and 20, every 180° rotation of the rotating plate mount 1603 and rotating plate insert 1604 results in the same pass-through areas 1901 and 1902, such that within one complete rotation of the rotating plate mount 1603 and rotating plate insert 1604 results in two identical pressure peaks in shape and amplitude. The resultant position after 180° rotation is that the rotating plate mount 1603 and rotating plate insert 1604 overlap the passthrough sections of the stationary plate insert 1601 and stationary plate mount 1602 in the same manner as at 0°. As the rotating plate mount 1603 and rotating plate insert 1604 continue to rotate beyond 180°, the pattern repeats until the rotating pieces are in their original position. FIG. 20 shows the rotating plate mount 1603 and rotating plate insert 1604 rotating behind the stationary plate insert 1601 and stationary plate mount 1602 at twenty degree intervals. Position 2001 is at 0°, position 2002 is at 20°, position 2003 is at 40°, position 2004 is at 60°, position 2005 is at 80°, position 2006 is at 100°, position 2007 is at 120°, position 2008 is at 140°, position 2009 is at 160°, and position 2010 is at 180°. As can be seen, the pass through areas are equal, only flipped about a horizontal axis, between position 2001 and 2010, between positions 2002 and 2009, between positions 2003 and 2008, between positions 2004 and 2007, and positions 2005 and 2006. As rotation continued beyond position 2010, the same pass through areas repeat, with the next image (after 200° of rotation) being a mirror image of position 2009 above a vertical axis, the next a mirror image of 2008 about a vertical axis, and so on. Comparing the pressure spikes in FIG. 15 with the valve positions of FIG. 20, the first trough 1501 would correspond to the open most position 2001, and the pressure spike 1502 would correspond to a position between positions 2005 and 2006, and the point when the valves were at their closed-most positions, which would be at the (unshown) 90° position. The second trough 1503 would correspond with the open-most position 2010. The following trough 1504 would correspond with a position at the end of a full cycle, 360° of revolution. In that manner, two complete pulses occur within every cycle, resulting in a repeated amplitude and time interval each time. The identical pressure peaks are a result in this embodiment of the fan-shaped pass through area 1608 transversing a circular pass through area 1605 in a regular, repeated manner twice per cycle. At the same time, the circular pass through section 1607 opposite the fan-shaped area 1608 transverses the opposite circular pass through areas 1605. Because the percussive force is directly related to the combined pass-through areas (1802-1806) of the stationary plate insert 1601, stationary plate mount 1602, rotating plate mount 1603, and rotating plate insert 1604, this repeated identical cycle results in repeated symmetrically sized and symmetrically timed pressure pulses. As shown in FIG. 15, one complete revolution results in two of the identical pressure peaks and pressure troughs per rotation. In a typical deployment, the rotor rotation is approximately constant for a constant drilling fluid pressure, which results in a regular and smooth cyclic rotation. Based on the symmetric positioning of the pass-through sections of the stationary plate insert 1601, stationary plate mount 1602, rotating plate mount 1603, and rotating plate insert 1604 and the regular and smooth rotation of the rotating plates, the resultant pressure peaks shown in FIG. 15 are spaced at equal time intervals.

In one embodiment, the matching valve pieces have tab-and-slots positioned such that the two pieces with matching circular cuts, the stationary plate mount and the stationary mount insert can be placed together so that each is functionally non-rotational with respect to the other. Likewise, the two pieces with one circular cut-out and one fan-shaped have tab and slots to prevent their relative rotation. With respect the vibrating tool in general, the two aft pieces are in communication with the rotor and stator power section and are therefore capable of rotation as fluid flow causes rotational of the stator. In the preferred embodiment, the two aft pieces are those with the fan cut outs. The two other pieces are non-rotating with respect to the vibrating tool and the other valve pieces.

In a preferred embodiment, all components are made of alloy steel except the valve inserts which are tungsten carbide and the rotor which is stainless steel. In most embodiments for use of hydrocarbon extraction, the vibratory tool can have a diameter as small as 3⅛" and can be as large as industry application requires.

Figure 8A:
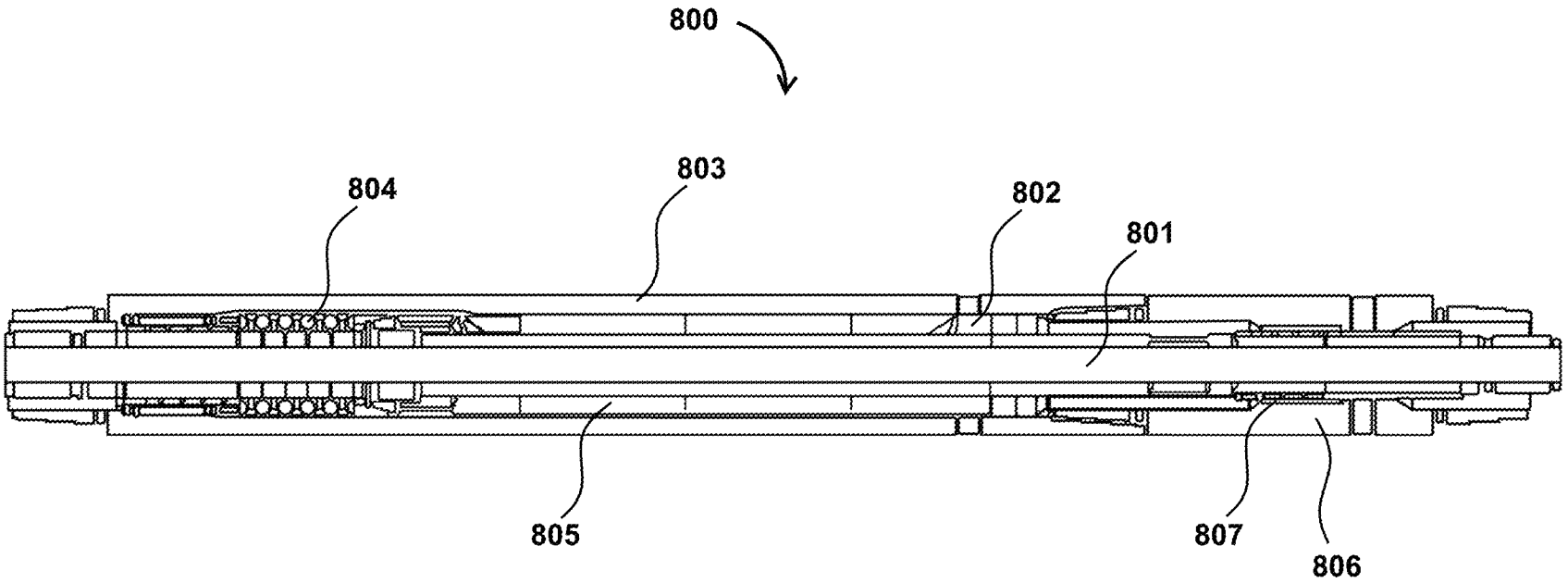
FIG. 8*a* shows a side sectional view of the eccentric mass assembly.
Figure 8B:
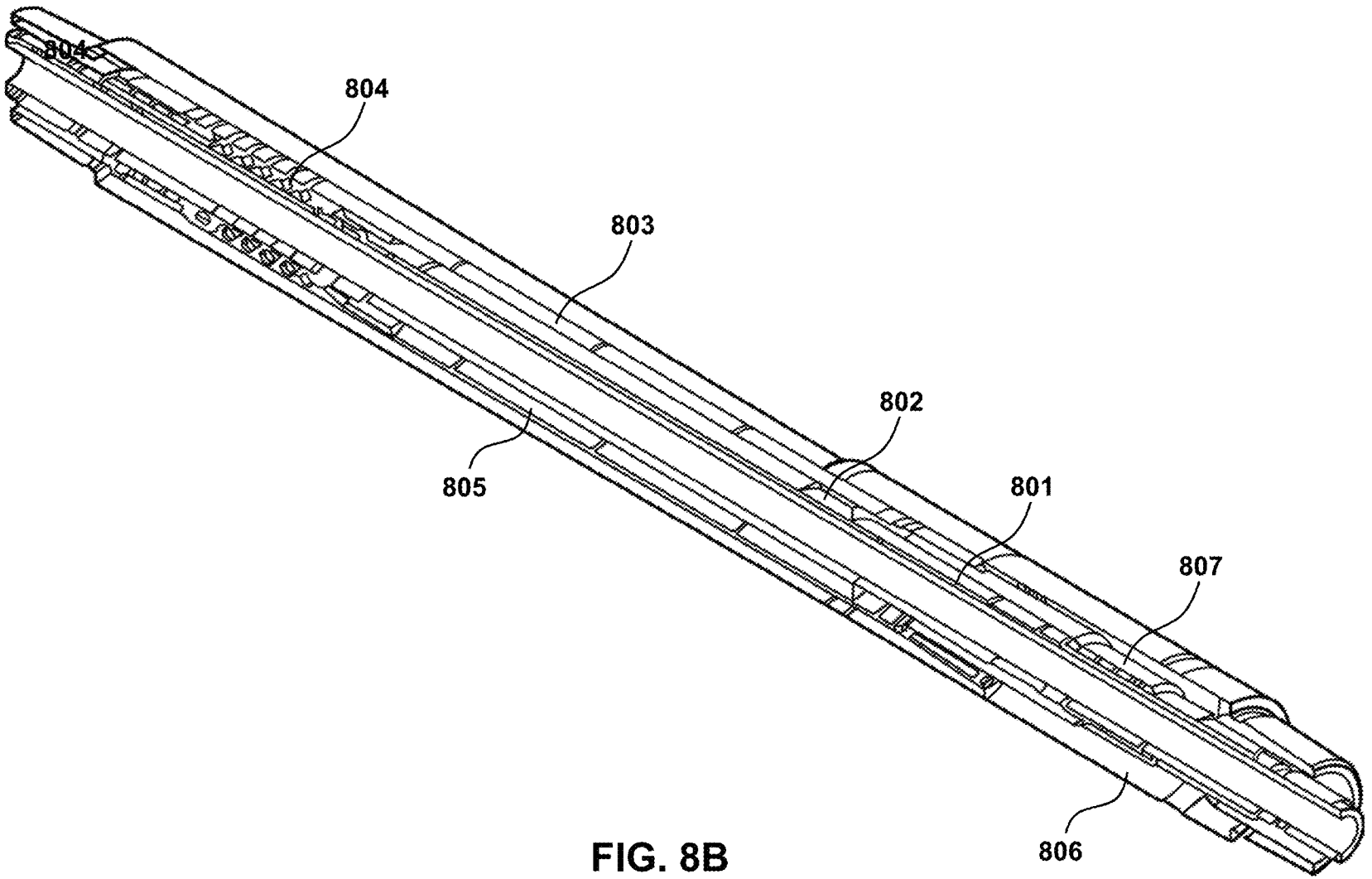
FIG. 8*b* shows an orthogonal sectional view of the eccentric mass assembly.
Figure 9:
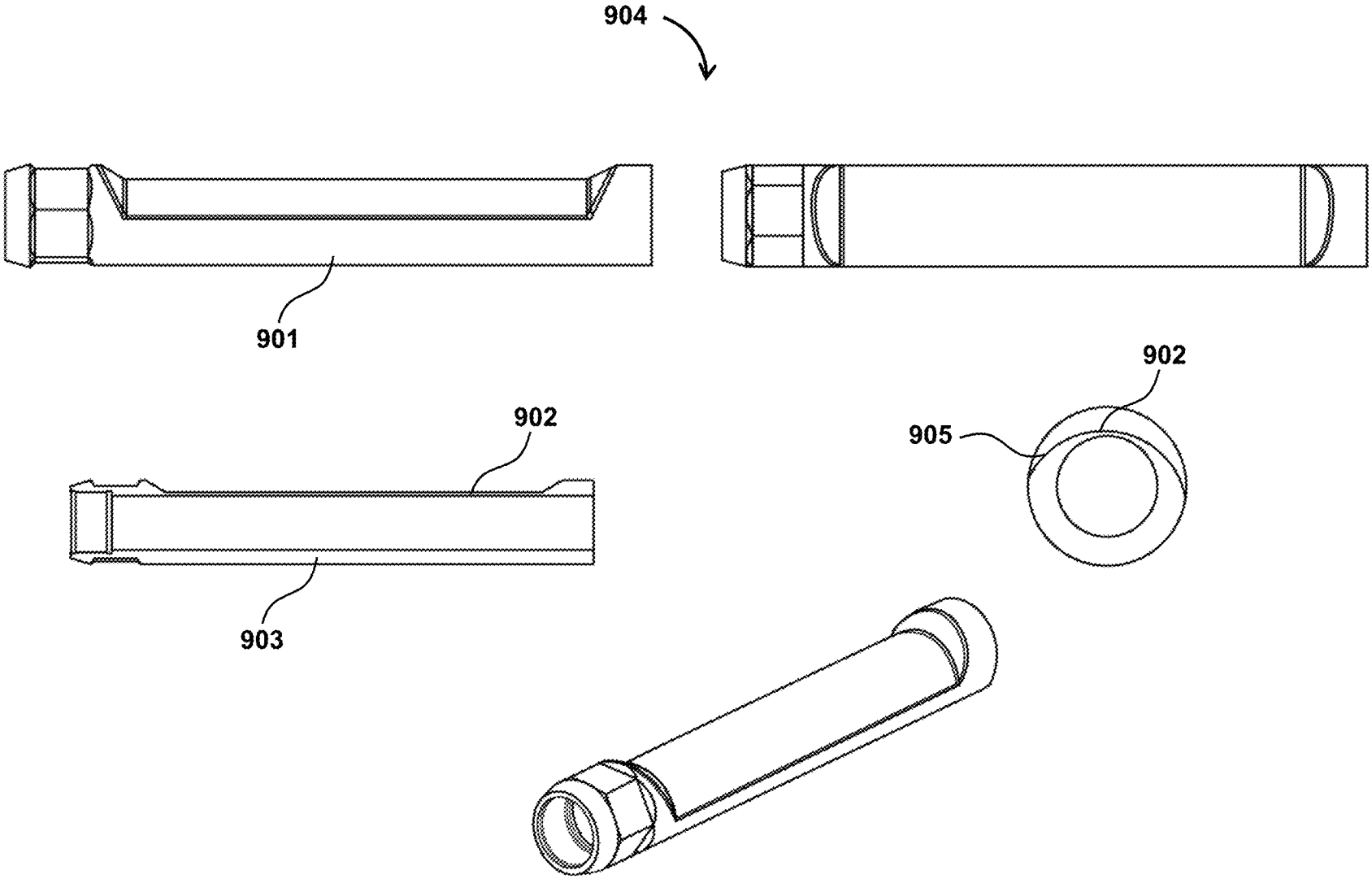
FIG. 9 shows multiple views of the eccentric mass, including a top view, side view, cross sectional side view, cross sectional front view, and orthogonal view.
Figure 10A:
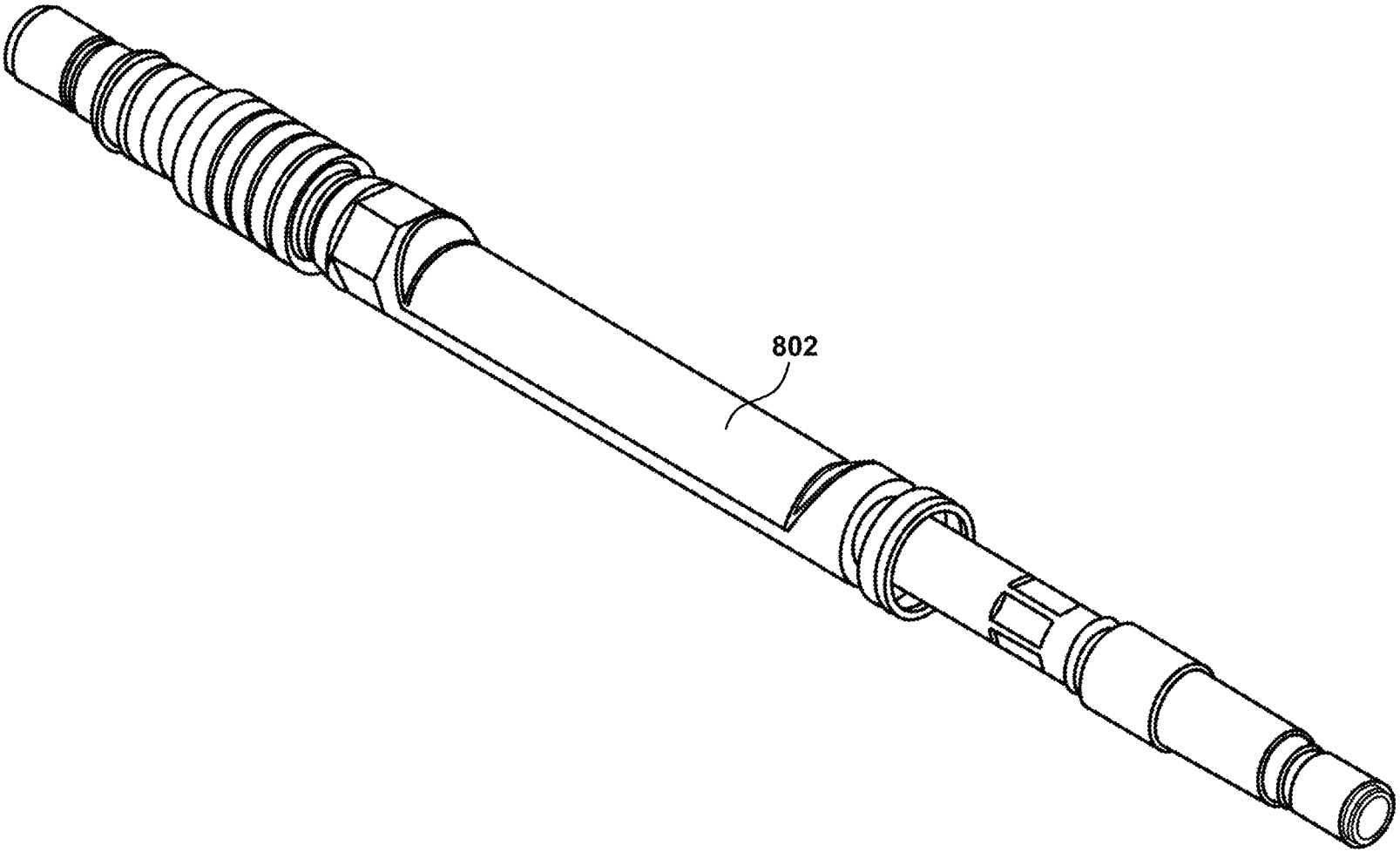
FIG. 10*a* shows an orthogonal view of the eccentric mass assembly with external housing removed.
Figure 10B:
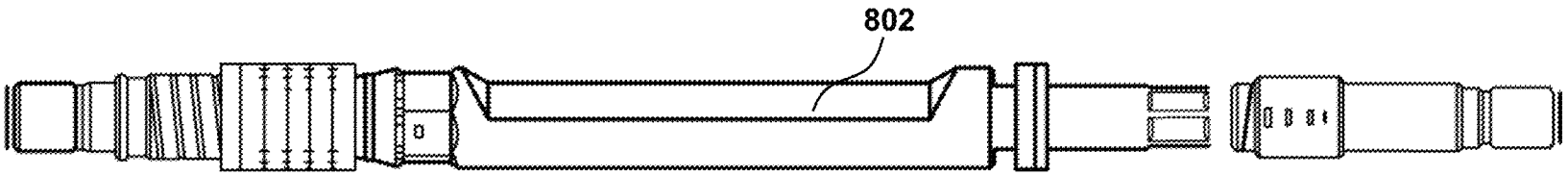
FIG. 10*b* shows a side view of the eccentric mass assembly with external housing removed.

In certain embodiments, lateral movement is enhanced by the rotational movement of an eccentric mass. The center of mass of the eccentric mass is off the z-coordinate midline of the vibratory tool. The eccentric mass is rotated about the vibratory tool causing substantial motion in the directions perpendicular to the axis of the vibratory tool. From a coordinate perspective, with the z-axis running the length of the vibratory tool, the eccentric mass causes movement in the x- and y-directions. In a preferred embodiment as shown in FIGS. 8*a* and 8*b*, a drive shaft 801 runs the length of the eccentric mass assembly section. Affixed to the drive shaft 801 is the eccentric mass 802. The assembly in this embodiment is contained within the bearing housing 803, which utilizes bearings (or rock bit balls) 804 to facilitate rotation with a minimum of wear and resistance to the internal rotation and the eccentric forces caused by the eccentric mass 802 while providing robust support to the vibrations caused by the lateral displacement of the tool due to the inertial forces of the eccentric mass rotating. In the embodiment of FIGS. 8*a* and 8*b*, the radial bearings are arranged in four rings of sixteen bearings. The eccentric mass is further incased within the internal sleeve 805. In the fore portion of the assembly, the lower bearing sub 806 contains rotating radial bearing 807 to facilitate low friction rotation. In this embodiment, further bearings are used to support against eccentric forces and thrust loads. The eccentric mass of this embodiment is shown in isolation in FIG. 9 and the eccentric mass assembly, without certain housing, is shown in FIGS. 10*a* and 10*b*. It should be understood that the particular arrangement is a preferred embodiment but could have many variations. The rotation of the eccentric mass about the z-centerline of the vibratory tool can be controlled by the speed and pressure of the drilling fluid through the power section. In preferred embodiments and best modes, the eccentric mass is rotated at 8-10 Hz. In the preferred embodiment, operation at this frequency minimizes MWD (measuring while drilling) and LWD (logging while drilling) interference, in part because the design is tolerant of fluctuations in flow rate changes, allowing the operator to continue operation without substantial alteration of performance which tends to introduce extraneous noise into monitoring equipment, equating to loss of monitoring ability of the downhole tools and conditions. In certain embodiments, the eccentric mass and the rotating plate mount 1603 and rotating plate insert 1604 are connected by linkage that causes the rotation of each to be in synch. In these embodiments, the tool can be tuned by placement of the eccentric mass in a different position relative to the pass through sections 1607, 1608. In this manner, the combinatory effects of the axial vibration and radial vibration can be modified to enhance the impact of the other. In certain embodiments, the tool is tuned such that the fluid flow of the drilling fluid around the eccentric mass 802 is least disruptive to laminar flow at the valves. In one such embodiment, the tool is tuned such that the eccentric mass is substantially in line with one of the pass through valve sections that is offset from the centerline of the tool. In this manner, the eccentric mass 802 is considered to be substantially in line with a pass through section if it is oriented within 10° of the pass through section. That is, the eccentric mass is within 10° of vertical when the pass through section is at its vertical position. In this embodiment, the largest pressure drop will occur when, in the case of a lateral bore, the eccentric mass 802 is at its vertical topmost and bottommost positions (relative to the horizontal bore). This is the case because of the symmetric pressure peaks and troughs that occur twice per revolution of the valves. In other embodiments when the positioning of the tool downhole is predictable, tuning can be based on the eccentric mass 802 is positioned to provide maximum vertical movement of the tool when lying in a horizontal bore at the time of maximum axial percussive force. This tuning allows for maximum weight on the bit during those percussive forces. This turning accounts for various tuning factors, including the timing of the rotation of the eccentric mass 802, the inertial properties of the tool with drilling fluid and the drilling string, the expected fluid flow in particular deployments, and the fluid dynamics of the particular drilling mud used. In various embodiments, the tool can be tuned in this manner by placing the eccentric mass 802 perpendicular to, or 90° off, the pass through sections of the rotating plates. Accounting for the tuning factors, the alignment can be within 20° in either direction off the perpendicular in many embodiments. The tool can be tuned for different purposes as well, including for limiting wear, coordination with other tools, maximizing pressure spikes, and otherwise.

In some embodiments, the eccentric mass is an elongated piece with pronounced asymmetry such that its center of mass on an axis perpendicular to the z-axis, or longitudinal axis, is offset of the centerline of the vibratory tool. With respect to the embodiment shown in FIGS. 9 and 10*a* and 10*b*, the pronounced asymmetry is formed by having an elongated substantially cylindrical mid-section 901 with a portion of the midsection removed along its length on approximately one half of the circumference of the substantially cylindrical portion. As a result, the wall of approximately half of the mid-section of the mass is substantially greater than the wall of the other approximately half. In the embodiment shown in FIGS. 9 and 10*a* and 10*b*, the thin wall portion at its thinnest 902 is approximately $\frac{1}{8}^{th}$ the thickness of the thick wall portion 903. That is, the ratio of the thickest to the thinnest areas in the wall at a cross section is 8:1. In many embodiments, different ratios are appropriate and are utilized depending on the sizing of the particular vibratory tool, the materials needed, the internal and external pressures anticipated, the usage, the forces desired, and the frequency of anticipated rotation. In most cases, a ratio of the thickest to the thinnest areas in the wall at a cross section of 5:1 or greater is sufficient for the embodiments disclosed herein. A cross section along the mid-section 901 is shown in 904, shows the wall is of variable thickness as the outer surface 905 of the thin walled portion follows a general circular arc non-concentric with the substantially cylindrical mid-section 901. Because the eccentric mass of this embodiment is eccentric only along the mid-section, the longer the mid-section, the more distant from the midline of the vibratory tool the center of mass of the entire eccentric mass. Under the embodiments disclosed herein, the eccentric mass has a broad effective range of offset center of mass from the centerline of the vibratory tool including offset by 5% of the radius of vibratory tool to 98% as appropriate for the size, usage, and materials of the vibratory tool at issue. There are many options that can be utilized for creating an eccentric mass, including intentionally weighting one side, using different materials on different sides, geometrically shaping items to bias to one side, and any combination of the three. Each is contemplated within this disclosure. In addition, the lateral forces can be generated by a plurality of individual eccentric masses placed throughout the vibratory tool rotating synchronously or asynchronously. The eccentric mass can be a variety of shapes and sizes, including offset disks or disk segments in cross section.

Figure 11A:
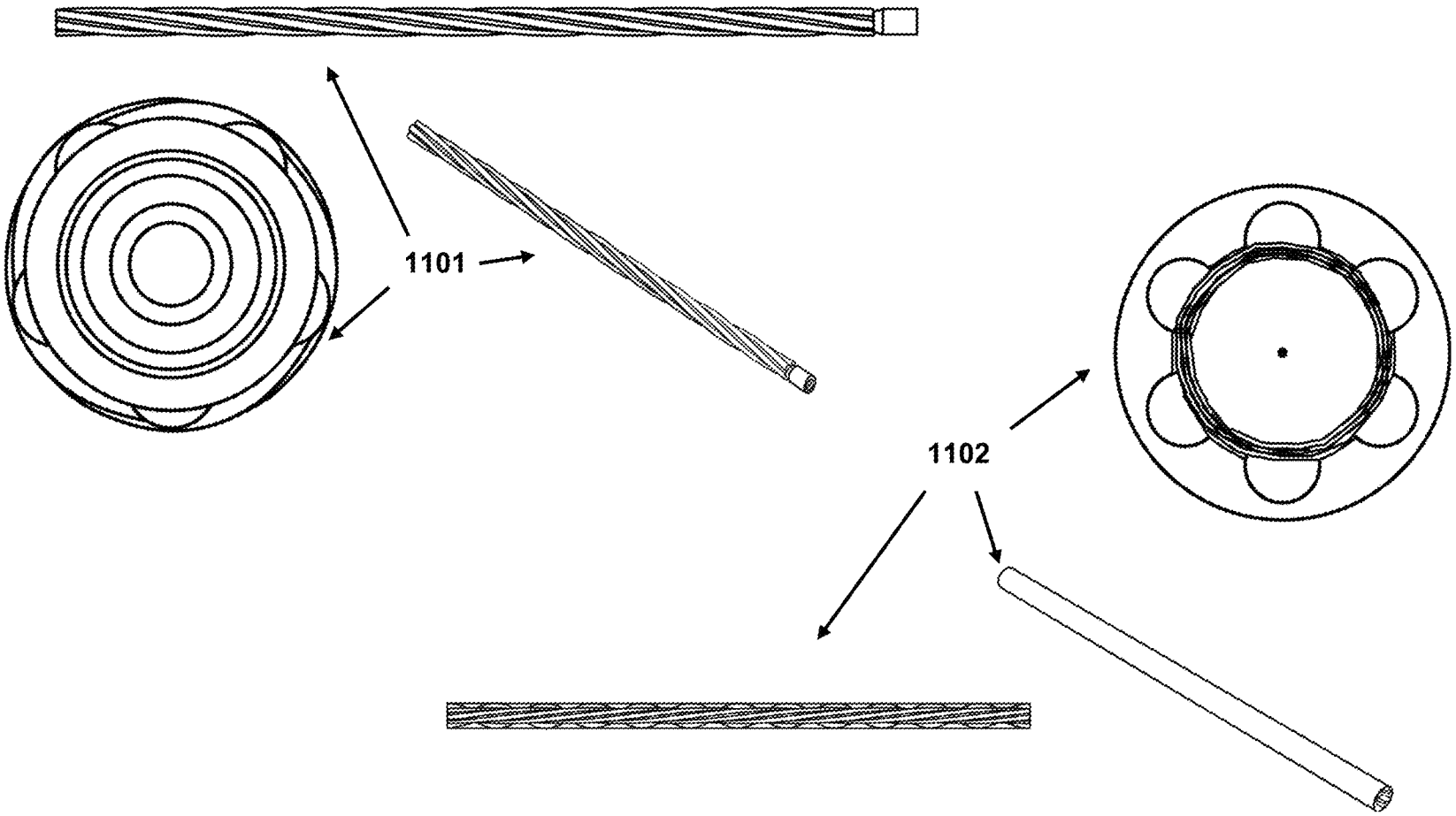
FIG. 11*a* shows the rotor and stator in side view, front view, and orthogonal view.
Figure 11B:
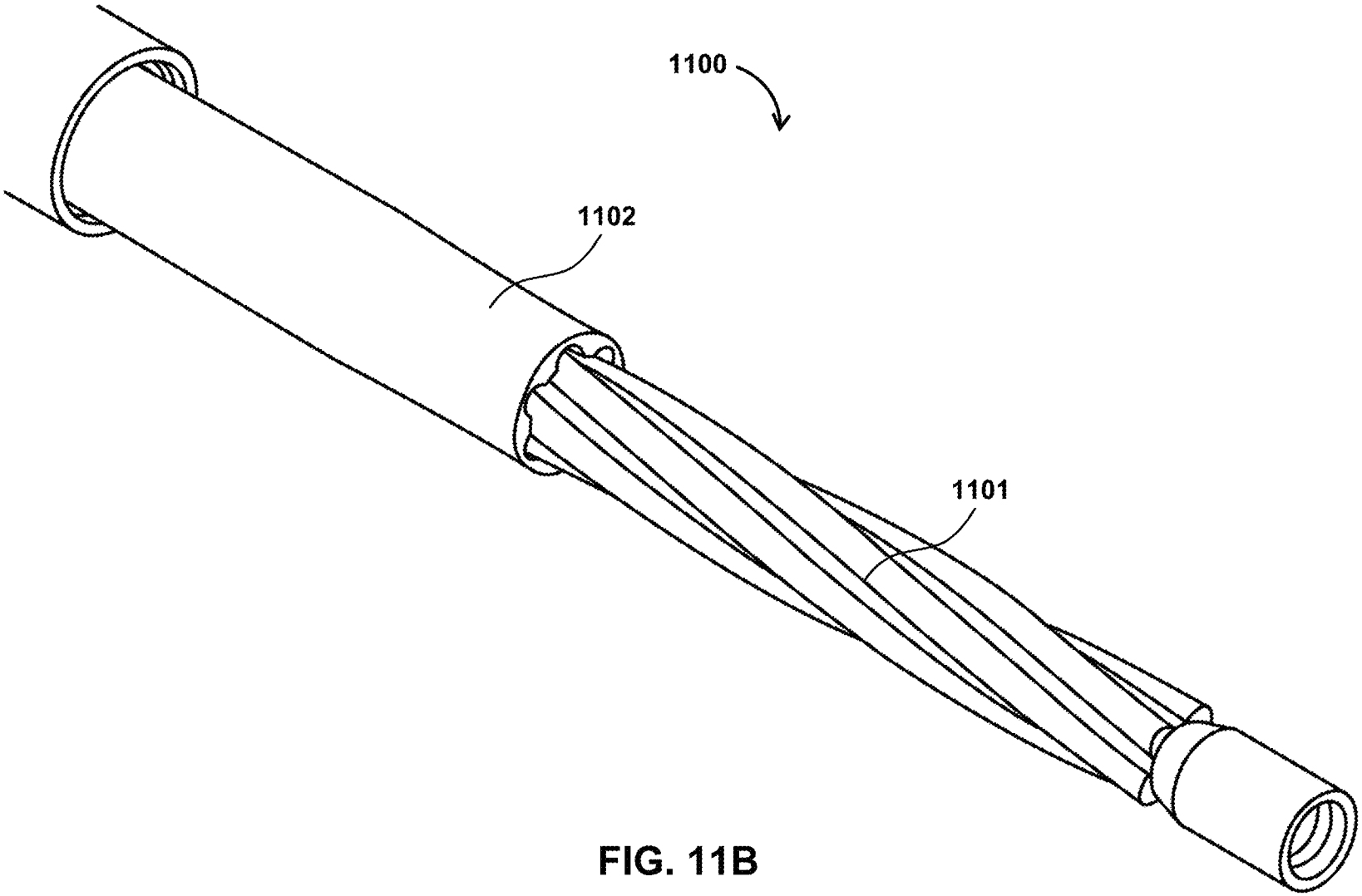
FIG. 11*b* shows a detail of the partially exploded view of the power section of an embodiment of the vibrating tool.
Figure 11C:
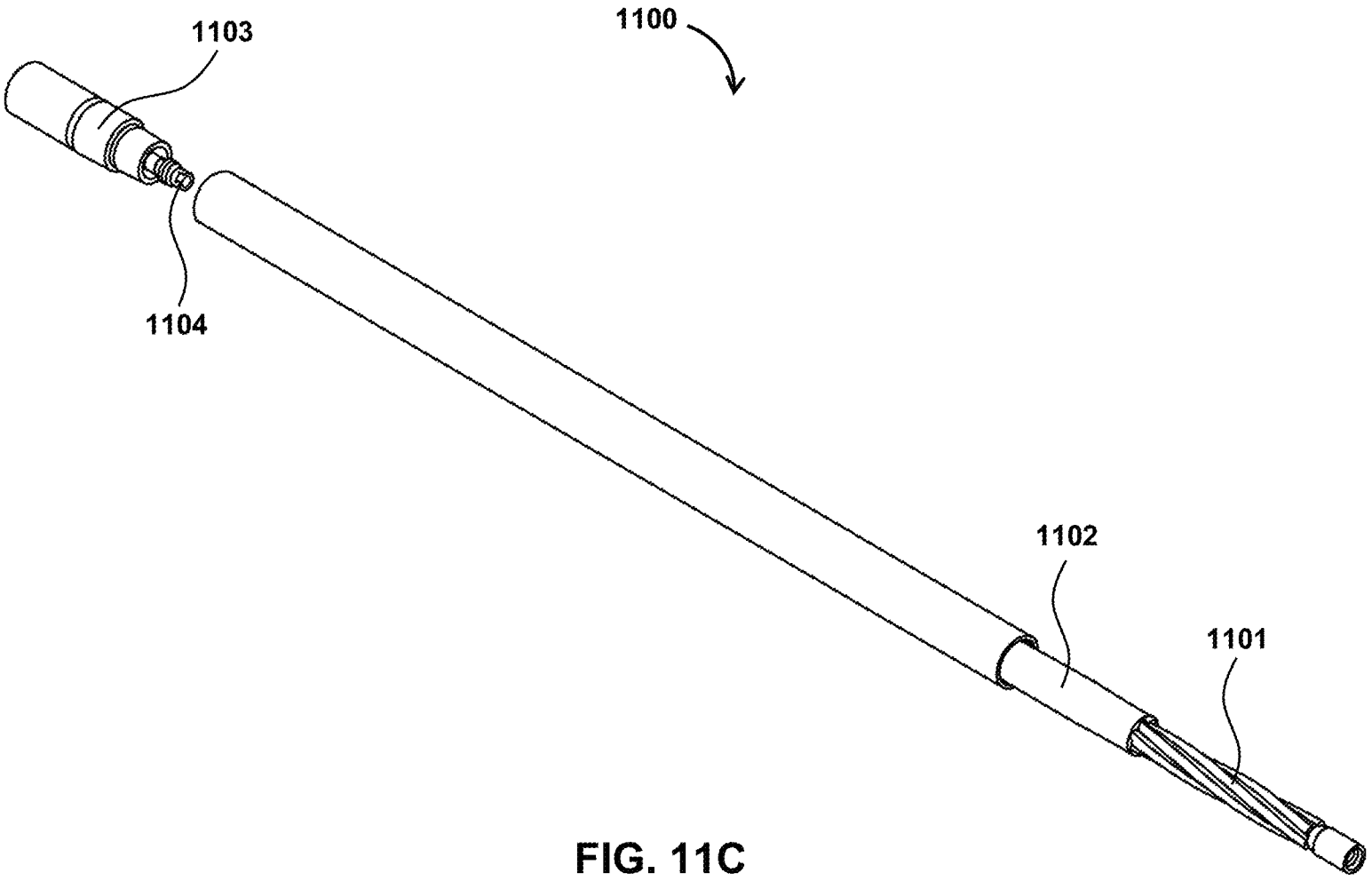
FIG. 11*c* shows a partially exploded view of the power section of an embodiment of the vibrating tool.
Figure 12:
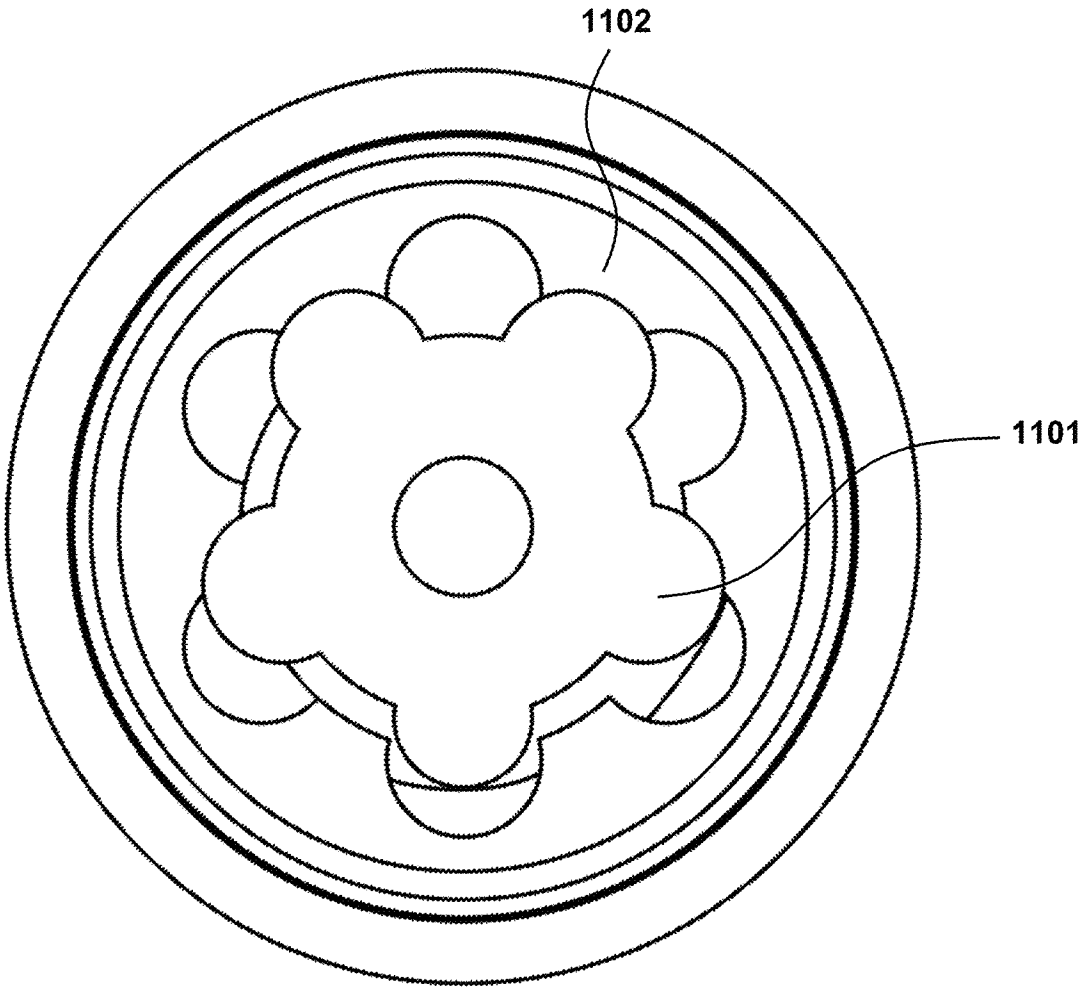
FIG. 12 shows a cross section of the power section.

In some embodiments, power is generated by a rotor and stator arrangement. In a preferred embodiment, the rotor has five lobes and the stator has six lobes. The flow of drilling fluid along the rotor provides torque as it rotates within the stator. In some embodiments, the stator is constructed of materials that minimize the likelihood of delamination from the housing. The rotor-stator can have various numbers of lobes. In the embodiment of FIGS. 11*a*, 11*b*, and 11*c*, the rotor 1101 has 5 lobes and the stator 1102 has six lobes. As is apparent in FIG. 12, the five lobe rotor is designed to fit imperfectly within the six lobe stator. The resultant arrangement allows for drilling fluid flow within the stator and exert forces on the rotor causing it to rotate around its axis and nutate around the z-axis, the longitudinal axis of the vibratory tool. This rotation serves as the power station for the vibratory tool. The relationship between the rotor and the stator geometry determines the rotational speed and torque. The rotational speed is proportional to the flow rate and torque is proportional to the pressure drop in the fluid as it flows through the power section. The more lobes the higher the torque and the slower the rpm. It should be understood that power can be derived in multiple different manners, including through the use of a turbine. In the preferred embodiment of FIGS. 11*a*, 11*b*, and 11*c*, a rotor and stator is employed although other suitable options exist. Aft of the rotor-stator assembly is the top sub 1103 with the rotor catch 1104. The top sub 1103 can be configured to connect with surrounding drilling pipe through, e.g., threading the sub.

Figure 13:
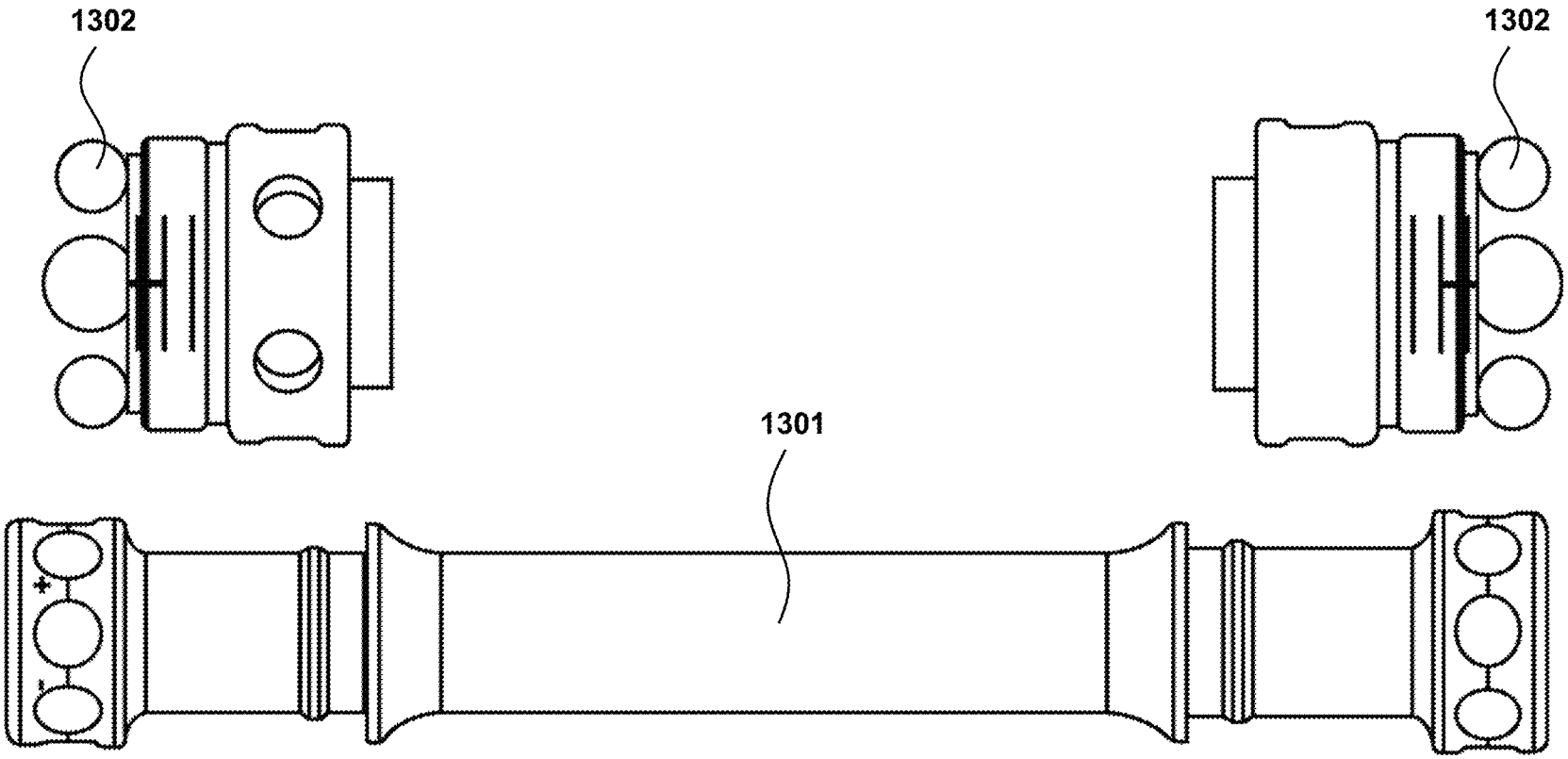
FIG. 13 shows a partially exploded view of a transmission section between the power section and the eccentric mass.

In some embodiments, the rotor stator power section assembly is connected to the eccentric mass assembly with the use of the transmission section, where the eccentric motion from the rotor is transmitted as concentric motion to the eccentric mass and drive shaft using a constant-velocity (CV) joint and a CV shaft. As shown in the partially exploded embodiment of the transmission section of FIG. 13, the CV shaft 1301 transmits power from the rotor-stator to the eccentric mass, making such power concentric through engagement of an upper CV head and a lower section utilizing a plurality of rock bit balls 1302 on either end. This CV shaft transmission assembly also allows for continued use despite slight (e.g., less than 3°) bend in the vibratory tool as it travels downhole as occurs in sophisticated drilling geometries, and for use despite the nutation of the stator keeping that component off the centerline of the vibrating tool.

In a preferred arrangement, the vibratory tool is placed several thousand feet behind the bottom hole assembly, e.g., drill collars, subs such as stabilizers, reamers, shocks, hole-openers, and the bit sub and drilling bit. In this arrangement, the vibratory tool can provide pulsating forces along the drill string and to the drilling bit and can provide lateral forces to reduce the incidence of static friction.

In some arrangements, the tool is deployed with one or more shock tools fore or aft of the three axis vibration tool described herein. The shock tool can be utilized to reduce impact loading on the bottom hole assembly to extend bit life. The shock tool absorbs axial vibrations and isolates those vibrations from the bottom hole assembly. In doing so, the shock tool reduces lateral and torsional drill string vibrations, and related fatigue damage or failure of the rotary connections.

The teachings herein provide for, among other things, a downhole vibrating tool comprising a power station comprising a rotor and a stator; an axial shock assembly comprising a valve assembly; and a lateral vibration assembly comprising an eccentric mass, wherein the valve assembly comprises a rotating valve and a stationary valve, the rotating valve being rotated by the power station wherein the rotor is a five lobe rotor and the stator is a six lobe stator, wherein the eccentric mass is rotated by the power station wherein the rotor and stator generate torque through fluid flow through the vibratory tool, and wherein said rotor is rotationally coupled with the eccentric mass by a constant velocity shaft, the constant velocity shaft being functionally coupled with both the rotor and the eccentric mass.

Some aspects of the present disclosure include a vibrating tool having an interconnected power section, axial shock assembly and lateral vibration assembly wherein the power section comprising a rotor and a stator, the rotor comprising a plurality of lobes and the stator comprising a second plurality of recesses adapted to receive the plurality of lobes, the number of recesses greater than the number of lobes; the axial shock assembly comprising a valve assembly, the axial shock assembly adapted to vary fluid flow therethrough; and the lateral vibration assembly comprising an eccentric mass; wherein the power section, the axial shock assembly and the lateral vibration assembly are aligned linearly.

Some aspects of the present disclosure include the tool above wherein the valve assembly comprises a rotating valve and a stationary valve, the rotating valve being rotated by the power section.

Some aspects of the present disclosure include the tool above wherein the rotor is a five lobe rotor and the stator is a six lobe stator.

Some aspects of the present disclosure include the tool above wherein the eccentric mass that is rotated by the power section.

Some aspects of the present disclosure include the tool above wherein the rotor and stator that generate torque through fluid flow through the vibrating tool, and wherein said rotor is rotationally coupled with the eccentric mass by a constant velocity shaft, the constant velocity shaft being functionally coupled with both the rotor and the eccentric mass.

Some aspects of the present disclosure include the vibrating tool above, wherein the rotating valve comprises a pass through section offset from a centerline of the rotating valve; and wherein the vibrating tool is tuned such that the eccentric mass is within 10° of the pass through section.

Some aspects of the present disclosure include the tool above wherein the valve assembly comprises a rotating valve and a stationary valve sized and positioned such that the valve assembly has a highest flow-through area and a lowest flow-through area, wherein the ratio of the highest flow-through area to the lowest flow-through area is greater than 10:1.

Some aspects of the present disclosure include the tool above wherein at least one of the rotating valve and the stationary valve comprising a fan-shaped pass-through area.

Some aspects of the present disclosure include the tool above wherein the eccentric mass that comprises a substantially cylindrical mid-section with a wall thickness that varies from its thickest to its thinnest at a ratio of greater than 5:1.

Some aspects of the present disclosure include the tool above wherein the vibrating tool has an aft end and a fore end, wherein the fore end is an end of the vibrating tool in the direction of drilling; wherein to vibrating tool is axially arranged from the fore end to the aft end: the axial shock assembly, the lateral vibration assembly, and the power section.

Some aspects of the present disclosure include the tool above wherein at least one of the rotating valve and the stationary valve comprising a circular pass-through section and a fan-shaped pass-through section and the other of the rotating valve and the stationary valve comprises two circular pass-through sections; and the rotating valve can rotate about an axis and with the stationary valve form an open-most configuration and a closed-most configuration, wherein the open-most configuration comprises a total open-most pass-through area in which a circular pass-through section of the rotating valve and a circular pass-through section of the stationary valve are axially concentric and the other circular pass-through section of the stationary valve or the rotating valve and the fan-shaped pass-through section have a largest overlap; and wherein the closed-most configuration comprises a total closed-most pass-through area in which the fan-shaped pass-through section of the rotating valve or the stationary valve is not axially aligned with any portion of the two circular pass-through sections on the other of the rotating valve or the stationary valve and the circular pass-through section of the same rotating valve or the stationary valve is minimally axially aligned with the two circular pass-through sections of the of the other of the rotating valve or the stationary valve.

Some aspects of the present disclosure include the tool above wherein each of the circular pass-through areas that are the same diameter; the total pass-through area in the closed-most configuration is 8-16% of the pass-through area of one of the circular pass-through areas; and the total pass-through area in the open-most configuration is 170-195% of the pass-through area of one of the circular pass-through areas.

Some aspects of the present disclosure include a three axis vibrating tool for use in a drilling string having an operating state, comprising: a power section powered by fluid flow that generates torque when in its operating state; a lateral vibration section comprising lateral vibration components that, when in its operating state, vibrate the tool in a lateral direction, the lateral direction being perpendicular to the drilling string at a point nearest the vibrating tool; an axial vibration section comprising axial vibration components that, when in its operating state, vibrate the tool in an axial direction, the axial direction being parallel to the drilling string at a point nearest the vibrating tool; and wherein the power section is aft of the lateral vibration section and the lateral vibration section is aft of the axial vibration section; and wherein in the operating state, the torque is transferred to the lateral vibration section and the axial vibration section to cause movement of at least one of the lateral vibration components and at least one of the axial vibration components, resulting in vibration in the lateral direction and the axial direction.

Some aspects of the present disclosure include the three axis vibrating tool having a centerline, such centerline being defined as a line parallel with the longest dimension of the three axis vibrating tool and located at the center of a cross section of a cylindrical portion of the three axis vibrating tool; and the lateral vibration section comprises an eccentric mass, said eccentric mass having a center of mass distant from the centerline and capable of rotation about the centerline.

Some aspects of the present disclosure include the tool above wherein the power section comprising a five lobe stator and a six lobe rotor.

Some aspects of the present disclosure include the tool above wherein the axial vibration section comprising a valve comprising a plurality of valves plates, at least one of the plurality of valve plates capable of rotation about the centerline and at least one of the plurality of valve plates stationary about the centerline.

Some aspects of the present disclosure include the tool above wherein the valve is positionable at different total pass-through areas, the different total pass-through areas defined by areas created by overlap of pass-through areas of the plurality of valve plates in the valve plates' different positions as the at least one valve plate rotates about the centerline, wherein for all different positions of the valve plates, the total pass-through area is greater than zero.

Some aspects of the present disclosure include the tool above wherein at least one of the plurality of valve plates has a fan-shaped pass-through area and a circular pass-through area, and at least one of the plurality of valve plates has two circular pass through areas.

Some aspects of the present disclosure include the tool above wherein each pass-through area on each of the plurality of valve plates is sized and positioned such that some portion of a pass-through area of each of the plurality of valve plates overlaps with some portion of a pass-through area of each of the other valve plates at all positions of the at least one of the plurality of valve plate capable of rotation about the centerline.

Some aspects of the present disclosure include the tool above wherein the valve is positionable at an open-most configuration and a closed-most configuration, wherein in the open-most configuration a pass-through area of at least one of the plurality of valve plates capable of rotating about the centerline is axially collinear with a pass-through area of at least one of a plurality of valve plates incapable of rotating about the centerline, and the closed-most configuration is the configuration in which a valve plate capable of rotation about the centerline is rotated 90 degrees from the open-most configuration.

The reader should appreciate that the present application describes several inventions. Rather than separating those inventions into multiple isolated patent applications, applicants have grouped these inventions into a single document because their related subject matter lends itself to economies in the application process. But the distinct advantages and aspects of such inventions should not be conflated. In some cases, embodiments address all of the deficiencies noted herein, but it should be understood that the inventions are independently useful, and some embodiments address only a subset of such problems or offer other, unmentioned benefits that will be apparent to those of skill in the art reviewing the present disclosure. Due to costs constraints, some inventions disclosed herein may not be presently claimed and may be claimed in later filings, such as continuation applications or by amending the present claims. Similarly, due to space constraints, neither the Abstract nor the Summary of the Invention sections of the present document should be taken as containing a comprehensive listing of all such inventions or all aspects of such inventions.

It should be understood that the description and the drawings are not intended to limit the invention to the particular form disclosed, but to the contrary, the intention is to cover all modifications, equivalents, and alternatives falling within the spirit and scope of the present invention as defined by the appended claims. Further modifications and alternative embodiments of various aspects of the invention will be apparent to those skilled in the art in view of this description. Accordingly, this description and the drawings are to be construed as illustrative only and are for the purpose of teaching those skilled in the art the general manner of carrying out the invention. It is to be understood that the forms of the invention shown and described herein are to be taken as examples of embodiments. Elements and materials may be substituted for those illustrated and described herein, parts and processes may be reversed or omitted, and certain features of the invention may be utilized independently, all as would be apparent to one skilled in the art after having the benefit of this description of the invention. Changes may be made in the elements described herein without departing from the spirit and scope of the invention as described in the following claims. Headings used herein are for organizational purposes only and are not meant to be used to limit the scope of the description.

As used throughout this application, the word "may" is used in a permissive sense (i.e., meaning having the potential to), rather than the mandatory sense (i.e., meaning must). The words "include", "including", and "includes" and the like mean including, but not limited to. As used throughout this application, the singular forms "a," "an," and "the" include plural referents unless the content explicitly indicates otherwise. Thus, for example, reference to "an element" or "a element" includes a combination of two or more elements, notwithstanding use of other terms and phrases for one or more elements, such as "one or more." The term "or" is, unless indicated otherwise, non-exclusive, i.e., encompassing both "and" and "or." Terms describing conditional relationships, e.g., "in response to X, Y," "upon X, Y,", "if X, Y," "when X, Y," and the like, encompass causal relationships in which the antecedent is a necessary causal condition, the antecedent is a sufficient causal condition, or the antecedent is a contributory causal condition of the consequent, e.g., "state X occurs upon condition Y obtaining" is generic to "X occurs solely upon Y" and "X occurs upon Y and Z." Such conditional relationships are not limited to consequences that instantly follow the antecedent obtaining, as some consequences may be delayed, and in conditional statements, antecedents are connected to their consequents, e.g., the antecedent is relevant to the likelihood of the consequent occurring. Statements in which a plurality of attributes or functions are mapped to a plurality of objects (e.g., one or more processors performing steps A, B, C, and D) encompasses both all such attributes or functions being mapped to all such objects and subsets of the attributes or functions being mapped to subsets of the attributes or functions (e.g., both all processors each performing steps A-D, and a case in which processor 1 performs step A, processor 2 performs step B and part of step C, and processor 3 performs part of step C and step D), unless otherwise indicated. Further, unless otherwise indicated, statements that one value or action is "based on" another condition or value encompass both instances in which the condition or value is the sole factor and instances in which the condition or value is one factor among a plurality of factors. Unless otherwise indicated, statements that "each" instance of some collection have some property should not be read to exclude cases where some otherwise identical or similar members of a larger collection do not have the property, i.e., each does not necessarily mean each and every. Limitations as to sequence of recited steps should not be read into the claims unless explicitly specified, e.g., with explicit language like "after performing X, performing Y," in contrast to statements that might be improperly argued to imply sequence limitations, like "performing X on items, performing Y on the X'ed items," used for purposes of making claims more readable rather than specifying sequence. Statements referring to "at least Z of A, B, and C," and the like (e.g., "at least Z of A, B, or C"), refer to at least Z of the listed categories (A, B, and C) and do not require at least Z units in each category. Unless specifically stated otherwise, as apparent from the discussion, it is appreciated that throughout this specification discussions utilizing terms such as "processing," "computing," "calculating," "determining" or the like refer to actions or processes of a specific apparatus, such as a special purpose computer or a similar special purpose electronic processing/computing device. Features described with reference to geometric constructs, like "parallel," "perpendicular/orthogonal," "square", "cylindrical," and the like, should be construed as encompassing items that substantially embody the properties of the geometric construct, e.g., reference to "parallel" surfaces encompasses substantially parallel surfaces. The permitted range of deviation from Platonic ideals of these geometric constructs is to be determined with reference to ranges in the specification, and where such ranges are not stated, with reference to industry norms in the field of use, and where such ranges are not defined, with reference to industry norms in the field of manufacturing of the designated feature, and where such ranges are not defined, features substantially embodying a geometric construct should be construed to include those features within 15% of the defining attributes of that geometric construct. With respect to the cylindrical arrangement, shape, or orientation of particular portions, components or assemblies, the description should be understood in context of the art at issue, in that the overwhelming majority of all devices used in this field tend to be cylindrical in nature or designed to fit within cylindrical tubing or holes. As such, cylindrical (and the like) descriptions should be understood to allow for substantial deviation from the Platonic ideal and instead interpreted to mean that the described object is designed to function in a cylindrical environment with little interference.

We claim:

1. A vibrating tool comprising a power section comprising a rotor and a stator, the rotor comprising a plurality of lobes and the stator comprising a second plurality of recesses adapted to receive the plurality of lobes, the number of recesses greater than the number of lobes;

an axial shock assembly comprising a valve assembly comprising a rotating valve that is driven to rotate by the power section, the axial shock assembly adapted to vary fluid flow therethrough, wherein the rotating valve comprises a rotating disk having at least one port therein and a stationary disk having at least one port therein, such that the axial shock assembly is adapted to vary fluid flow therethrough by aligning and misaligning the at least one port of the rotating disk and the at least one port of the stationary disk; and a lateral vibration assembly comprising an eccentric mass that is driven to rotate by the power section along with the rotating valve, wherein the eccentric mass is positioned with respect to the at least one port of the rotating disk so as to tune the vibrating tool based on a relative positioning of the at least one port of the rotating disk and the eccentric mass.

2. The vibrating tool of claim 1, wherein the rotor is coupled to a drive shaft to which the eccentric mass and the rotating valve are coupled.

3. The vibrating tool of claim 1, wherein the rotor and stator generate torque through fluid flow through the vibrating tool, and wherein said rotor is rotationally coupled with the eccentric mass by a constant velocity shaft, the constant velocity shaft being functionally coupled with both the rotor and the eccentric mass.

4. The vibrating tool of claim 3, wherein the eccentric mass is within 10° of the port of the rotating disk.

5. The vibrating tool of claim 4, wherein the stationary disk is sized and positioned such that the valve assembly has a highest flow-through area and a lowest flow-through area, wherein the ratio of the highest flow-through area to the lowest flow-through area is greater than 10:1.

6. The vibrating tool of claim 5, wherein at least one of the ports comprises a fan-shaped pass-through area.

7. The vibrating tool of claim 1, wherein the eccentric mass comprises a substantially cylindrical mid-section with a wall thickness that varies from its thickest to its thinnest at a ratio of greater than 5:1.

8. The vibrating tool of claim 1, wherein the vibrating tool has an aft end and a fore end, wherein the fore end is an end of the vibrating tool in the direction of a bottom of a hole and the aft end is opposite the fore end, and wherein to vibrating tool is axially arranged from the fore end to the aft end: the axial shock assembly, the lateral vibration assembly, and the power section.

9. The vibrating tool of claim 1, wherein the rotating disk comprises a first ported component and a second ported component, and wherein the stationary disk comprises a third ported component and a fourth ported component, wherein:

the first ported component and second ported component have an equal number of ports;

the third ported component and fourth ported component have an equal number of ports;

the first and second ported components are stationary with respect to each other;

the third and fourth ported components are stationary with respect to each other; and the first and second ported components rotate with respect to the third and fourth ported components.

10. The vibrating tool of claim 1, wherein the eccentric mass is positioned substantially in line with the port of the rotating disk so as to tune lateral and axial vibrations for maximum impact.

11. The vibrating tool of claim 1, wherein the eccentric mass is positioned at least partially out of alignment with the port of the rotating disk.

12. A vibrating tool comprising:

a power section comprising a rotor and a stator, the rotor comprising a plurality of lobes and the stator comprising a second plurality of recesses adapted to receive the plurality of lobes, the number of recesses greater than the number of lobes;

an axial shock assembly comprising a valve assembly, the axial shock assembly adapted to vary fluid flow therethrough, wherein the valve assembly comprises at least a first, second, third, and fourth ported components, wherein the first ported component and second ported component have equal number of ports, wherein the third ported component and fourth ported component have equal number of ports, wherein the valve assembly comprises a rotating valve and a stationary valve, the rotating valve being rotated by the power section, wherein at least one of the first or second ported components comprises a fan-shaped pass- through section, and at least one of the third or fourth ported components comprises two circular pass-through sections, wherein at least one of the ported components is configured to rotate about an axis with respect to another of the ported components from an open-most configuration and a closed-most configuration, wherein the open-most configuration comprises a total open-most pass-through area in which a circular pass-through section of one ported component and the fan-shaped pass-through section of another ported component have a largest overlap, and wherein the closed-most configuration comprises a total closed-most pass-through area in which the fan-shaped pass-through section of one ported component is minimally axially aligned with the two circular pass-through sections of another ported component.

13. The vibrating tool of claim 12, wherein each of the circular pass-through areas are the same diameter, and wherein the total pass-through area in the closed-most configuration is 8-16% of the pass-through area of one of the circular pass-through areas.

14. A vibrating tool for use in a drilling string having an operating state, comprising:

a power section powered by fluid flow, wherein the power section is configured to generate torque in response to the fluid flow;

an axial vibration section comprising at least four coaxial ported axial vibration components, at least one of which is driven to rotate relative to another one of the axial vibration components by the torque generated by the power section, wherein the coaxial ported axial vibration components are configured to generate pulses in the fluid flow that vibrate the tool in an axial direction, the axial direction being parallel to the drilling string at a point nearest the vibrating tool; and a lateral vibration section comprising an eccentric mass that is driven to rotate by the power section along with the coaxial ported axial vibration components so as to vibrate the tool in a lateral direction, wherein the eccentric mass is positioned with respect to one or more ports of the ported axial vibration components so as to tune the vibrating tool based on a relative positioning of the one or more ports and the eccentric mass.

15. The vibrating tool of claim 14, wherein:

the vibrating tool has a centerline, such centerline being a line parallel with the longest dimension of the vibrating tool and located at the center of a cross section of a cylindrical portion of the vibrating tool; and the eccentric mass has a center of mass offset from the centerline and configured to rotate about the centerline.

16. The vibrating tool of claim 15, wherein the power section comprises a five lobe stator and a six lobe rotor.

17. The vibrating tool of claim 16, wherein the at least four ported axial vibration components comprise a plurality of valves plates.

18. The vibrating tool of claim 15, wherein the at least four ported axial vibration components are positionable to form different total pass-through areas, the different total pass-through areas defined by areas created by overlap of pass-through areas of the ported axial vibration components in the ported axial vibration components' different positions as at least one ported axial vibration component rotates about the centerline, wherein for all different positions of the ported axial vibration components, the total pass-through area is greater than zero.

19. The vibrating tool of claim 15, wherein at least one of the ported axial vibration components has a fan-shaped pass-through area, and at least one of the plurality of ported axial vibration components has two circular pass through areas.

20. The vibrating tool of claim 18, wherein each pass-through area on each of the plurality of ported axial vibration components is sized and positioned such that some portion of a pass-through area of each of the plurality of ported axial vibration components overlaps with some portion of a pass-through area of each of the other ported axial vibration components at all positions of rotation.

21. The vibrating tool of claim 15, wherein the ported axial vibration components are positionable at an open-most configuration and a closed-most configuration, wherein in the open-most configuration a pass-through area of at least one of the plurality of rotatable ported axial vibration components is axially colinear with a pass-through area of at least one of a plurality of nonrotatable ported axial vibration components valve plates, and the closed-most configuration is the configuration in which a ported axial vibration components is rotated 90 degrees from the open-most configuration.

* * * * *